US009506463B2

(12) United States Patent
Locke et al.

(10) Patent No.: US 9,506,463 B2
(45) Date of Patent: Nov. 29, 2016

(54) DISC PUMP AND VALVE STRUCTURE

(75) Inventors: Christopher Brian Locke, Bournemouth (GB); Aidan Marcus Tout, Wiltshire (GB)

(73) Assignee: KCI Licensing, Inc., San Antonio, TX (US)

( * ) Notice: Subject to any disclaimer, the term of this patent is extended or adjusted under 35 U.S.C. 154(b) by 638 days.

(21) Appl. No.: 13/591,951

(22) Filed: Aug. 22, 2012

(65) Prior Publication Data

US 2013/0071273 A1 Mar. 21, 2013

Related U.S. Application Data

(60) Provisional application No. 61/537,431, filed on Sep. 21, 2011.

(51) Int. Cl.

| | |
|---|---|
| ***F04B 43/00*** | (2006.01) |
| ***F04B 43/04*** | (2006.01) |
| ***F04B 45/04*** | (2006.01) |
| ***F04B 45/047*** | (2006.01) |
| ***F04B 43/02*** | (2006.01) |

(52) U.S. Cl.

CPC ..... *F04B 43/046* (2013.01); *F04B 43/028* (2013.01); *F04B 45/045* (2013.01); *F04B 45/047* (2013.01)

(58) Field of Classification Search

CPC .. F04B 43/046; F04B 43/028; F04B 45/047; F04B 43/023; F04B 43/02; F04B 45/041; F04B 45/045; F04B 45/04

See application file for complete search history.

(56) References Cited

U.S. PATENT DOCUMENTS

| | | | |
|---|---|---|---|
| 1,355,846 | A | 10/1920 | Rannells |
| 2,547,758 | A | 4/1951 | Keeling |
| 2,632,443 | A | 3/1953 | Lesher |
| 2,682,873 | A | 7/1954 | Evans et al. |
| 2,910,763 | A | 11/1959 | Lauterbach |

(Continued)

FOREIGN PATENT DOCUMENTS

| | | |
|---|---|---|
| AU | 550575 A1 | 8/1982 |
| AU | 745271 | 4/1999 |

(Continued)

OTHER PUBLICATIONS

WO 2009/053027 Machine Translation.*

(Continued)

*Primary Examiner* — Charles Freay
*Assistant Examiner* — Christopher Bobish

(57) ABSTRACT

A dual-cavity pump having a pump body with a substantially elliptical shape including a cylindrical wall closed at each end by end plates is disclosed. The pump further comprises a pair of disc-shaped interior plates supported within the pump by a ring-shaped isolator affixed to the cylindrical wall of the pump body. The internal surfaces of the cylindrical wall, one of the end plates, one of the interior plates, and the ring-shaped isolator form a first cavity within the pump. The internal surfaces of the cylindrical wall, the other end plate, the other interior plate, and the ring-shaped isolator form a second cavity within the pump. The interior plates together form an actuator that is operatively associated with the central portion of the interior plates. The illustrative embodiments of the dual-cavity pump have three valves including one located within a common end wall between the cavities of the pump. Methods for fabricating the pump are also disclosed.

20 Claims, 18 Drawing Sheets

(56) References Cited

U.S. PATENT DOCUMENTS

| | | | |
|---|---|---|---|
| 2,969,057 | A | 1/1961 | Simmons |
| 3,066,672 | A | 12/1962 | Crosby, Jr. et al. |
| 3,367,332 | A | 2/1968 | Groves |
| 3,520,300 | A | 7/1970 | Flower, Jr. |
| 3,568,675 | A | 3/1971 | Harvey |
| 3,648,692 | A | 3/1972 | Wheeler |
| 3,682,180 | A | 8/1972 | McFarlane |
| 3,826,254 | A | 7/1974 | Mellor |
| 4,080,970 | A | 3/1978 | Miller |
| 4,096,853 | A | 6/1978 | Weigand |
| 4,139,004 | A | 2/1979 | Gonzalez, Jr. |
| 4,165,748 | A | 8/1979 | Johnson |
| 4,184,510 | A | 1/1980 | Murry et al. |
| 4,233,969 | A | 11/1980 | Lock et al. |
| 4,245,630 | A | 1/1981 | Lloyd et al. |
| 4,256,109 | A | 3/1981 | Nichols |
| 4,261,363 | A | 4/1981 | Russo |
| 4,275,721 | A | 6/1981 | Olson |
| 4,284,079 | A | 8/1981 | Adair |
| 4,297,995 | A | 11/1981 | Golub |
| 4,333,468 | A | 6/1982 | Geist |
| 4,373,519 | A | 2/1983 | Errede et al. |
| 4,382,441 | A | 5/1983 | Svedman |
| 4,392,853 | A | 7/1983 | Muto |
| 4,392,858 | A | 7/1983 | George et al. |
| 4,419,097 | A | 12/1983 | Rowland |
| 4,465,485 | A | 8/1984 | Kashmer et al. |
| 4,475,909 | A | 10/1984 | Eisenberg |
| 4,480,638 | A | 11/1984 | Schmid |
| 4,525,166 | A | 6/1985 | Leclerc |
| 4,525,374 | A | 6/1985 | Vaillancourt |
| 4,540,412 | A | 9/1985 | Van Overloop |
| 4,543,100 | A | 9/1985 | Brodsky |
| 4,548,202 | A | 10/1985 | Duncan |
| 4,551,139 | A | 11/1985 | Plaas et al. |
| 4,569,348 | A | 2/1986 | Hasslinger |
| 4,605,399 | A | 8/1986 | Weston et al. |
| 4,608,041 | A | 8/1986 | Nielson |
| 4,640,688 | A | 2/1987 | Hauser |
| 4,655,754 | A | 4/1987 | Richmond et al. |
| 4,664,662 | A | 5/1987 | Webster |
| 4,710,165 | A | 12/1987 | McNeil et al. |
| 4,733,659 | A | 3/1988 | Edenbaum et al. |
| 4,743,232 | A | 5/1988 | Kruger |
| 4,758,220 | A | 7/1988 | Sundblom et al. |
| 4,787,888 | A | 11/1988 | Fox |
| 4,826,494 | A | 5/1989 | Richmond et al. |
| 4,838,883 | A | 6/1989 | Matsuura |
| 4,840,187 | A | 6/1989 | Brazier |
| 4,863,449 | A | 9/1989 | Therriault et al. |
| 4,872,450 | A | 10/1989 | Austad |
| 4,878,901 | A | 11/1989 | Sachse |
| 4,897,081 | A | 1/1990 | Poirier et al. |
| 4,906,233 | A | 3/1990 | Moriuchi et al. |
| 4,906,240 | A | 3/1990 | Reed et al. |
| 4,919,654 | A | 4/1990 | Kalt et al. |
| 4,941,882 | A | 7/1990 | Ward et al. |
| 4,953,565 | A | 9/1990 | Tachibana et al. |
| 4,969,880 | A | 11/1990 | Zamierowski |
| 4,985,019 | A | 1/1991 | Michelson |
| 5,037,397 | A | 8/1991 | Kalt et al. |
| 5,086,170 | A | 2/1992 | Luheshi et al. |
| 5,092,858 | A | 3/1992 | Benson et al. |
| 5,100,396 | A | 3/1992 | Zamierowski |
| 5,134,994 | A | 8/1992 | Say |
| 5,149,331 | A | 9/1992 | Ferdman et al. |
| 5,167,613 | A | 12/1992 | Karami et al. |
| 5,176,663 | A | 1/1993 | Svedman et al. |
| 5,215,522 | A | 6/1993 | Page et al. |
| 5,232,453 | A | 8/1993 | Plass et al. |
| 5,261,893 | A | 11/1993 | Zamierowski |
| 5,278,100 | A | 1/1994 | Doan et al. |
| 5,279,550 | A | 1/1994 | Habib et al. |
| 5,298,015 | A | 3/1994 | Komatsuzaki et al. |
| 5,342,376 | A | 8/1994 | Ruff |
| 5,344,415 | A | 9/1994 | DeBusk et al. |
| 5,358,494 | A | 10/1994 | Svedman |
| 5,437,622 | A | 8/1995 | Carion |
| 5,437,651 | A | 8/1995 | Todd et al. |
| 5,527,293 | A | 6/1996 | Zamierowski |
| 5,549,584 | A | 8/1996 | Gross |
| 5,556,375 | A | 9/1996 | Ewall |
| 5,607,388 | A | 3/1997 | Ewall |
| 5,636,643 | A | 6/1997 | Argenta et al. |
| 5,645,081 | A | 7/1997 | Argenta et al. |
| 6,071,267 | A | 6/2000 | Zamierowski |
| 6,135,116 | A | 10/2000 | Vogel et al. |
| 6,241,747 | B1 | 6/2001 | Ruff |
| 6,287,316 | B1 | 9/2001 | Agarwal et al. |
| 6,345,623 | B1 | 2/2002 | Heaton et al. |
| 6,488,643 | B1 | 12/2002 | Tumey et al. |
| 6,493,568 | B1 | 12/2002 | Bell et al. |
| 6,553,998 | B2 | 4/2003 | Heaton et al. |
| 6,814,079 | B2 | 11/2004 | Heaton et al. |
| 8,297,947 | B2 * | 10/2012 | Van Rensburg et al. .. 417/413.2 |
| 2002/0077661 | A1 | 6/2002 | Saadat |
| 2002/0115951 | A1 | 8/2002 | Norstrem et al. |
| 2002/0120185 | A1 | 8/2002 | Johnson |
| 2002/0143286 | A1 | 10/2002 | Tumey |
| 2006/0232167 | A1 * | 10/2006 | Jordan ..... 310/324 |
| 2009/0087323 | A1 * | 4/2009 | Blakey et al. ..... 417/413.2 |
| 2010/0310397 | A1 * | 12/2010 | Janse Van Rensburg .... 417/488 |
| 2010/0310398 | A1 | 12/2010 | Janse Van Rensburg et al. |

FOREIGN PATENT DOCUMENTS

| | | | |
|---|---|---|---|
| AU | 755496 | | 2/2002 |
| CA | 2005436 | | 6/1990 |
| DE | 26 40 413 | A1 | 3/1978 |
| DE | 43 06 478 | A1 | 9/1994 |
| DE | 295 04 378 | U1 | 10/1995 |
| EP | 0100148 | A1 | 2/1984 |
| EP | 0117632 | A2 | 9/1984 |
| EP | 0161865 | A2 | 11/1985 |
| EP | 0358302 | A2 | 3/1990 |
| EP | 1018967 | B1 | 8/2004 |
| GB | 692578 | | 6/1953 |
| GB | 2 195 255 | A | 4/1988 |
| GB | 2 197 789 | A | 6/1988 |
| GB | 2 220 357 | A | 1/1990 |
| GB | 2 235 877 | A | 3/1991 |
| GB | 2 333 965 | A | 8/1999 |
| GB | 2 329 127 | B | 8/2000 |
| JP | 4129536 | | 4/1992 |
| JP | 2007092677 | A | 4/2007 |
| SG | 71559 | | 4/2002 |
| WO | WO 80/02182 | | 10/1980 |
| WO | WO 87/04626 | | 8/1987 |
| WO | WO 90/10424 | | 9/1990 |
| WO | WO 93/09727 | | 5/1993 |
| WO | WO 94/20041 | | 9/1994 |
| WO | WO 96/05873 | | 2/1996 |
| WO | WO 97/18007 | | 5/1997 |
| WO | WO 99/13793 | | 3/1999 |
| WO | WO 2006/111/775 | A1 | 10/2006 |
| WO | WO 2009/053027 | * | 4/2009 |
| WO | 2010139916 | A1 | 12/2010 |
| WO | WO 2010/139917 | | 12/2010 |

OTHER PUBLICATIONS

N.A. Bagautdinov, "Variant of External Vacuum Aspiration in the Treatment of Purulent Diseases of the Soft Tissues," *Current Problems in Modern Clinical Surgery: Interdepartmental Collection*, edited by V. Ye Volkov et al. (Chuvashia State University, Cheboksary, U.S.S.R. 1986);pp. 94-96 (certified translation).

Louis C. Argenta, MD and Michael J. Morykwas, PhD; "Vacuum-Assisted Closure: A New Method for Wound Control and Treatment: Clinical Experience"; Annals of Plastic Surgery, vol. 38, No. 6, Jun. 1997; pp. 563-576.

(56) References Cited

OTHER PUBLICATIONS

Susan Mendez-Eastmen, RN; "When Wounds Won't Heal" RN Jan. 1998, vol. 61 (1); Medical Economics Company Inc., Montvale, NJ, USA; pp. 20-24.
James H. Blackburn, II, MD, et al; "Negative-Pressure Dressings as a Bolster for Skin Grafts"; Annals of Plastic Surgery, vol. 40, No. 5, May 1998, pp. 453-457.
John Masters; "Reliable, Inexpensive and Simple Suction Dressings"; Letter to the Editor, British Journal of Plastic Surgery, 1998, vol. 51 (3), p. 267; Elsevier Science/The British Association of Plastic Surgeons, UK.
S.E. Greer, et al "The Use of Subatmospheric Pressure Dressing Therapy to Close Lymphocutaneous Fistulas of the Groin" British Journal of Plastic Surgery (2000), 53, pp. 484-487.
George V. Letsou, MD., et al; "Stimulation of Adenylate Cyclase Activity in Cultured Endothelial Cells Subjected to Cyclic Stretch"; Journal of Cardiovascular Surgery, 31, 1990, pp. 634-639.
Orringer, Jay, et al; "Management of Wounds in Patients with Complex Enterocutaneous Fistulas"; Surgery, Gynecology & Obstetrics, Jul. 1987, vol. 165, pp. 79-80.
International Search Report for PCT International Application PCT/GB95/01983; Nov. 23, 1995.
PCT International Search Report for PCT International Application PCT/GB98/02713; Jan. 8, 1999.
PCT Written Opinion; PCT International Application PCT/GB98/02713; Jun. 8, 1999.
PCT International Examination and Search Report, PCT International Application PCT/GB96/02802; Jan. 15, 1998 & Apr. 29, 1997.
PCT Written Opinion, PCT International Application PCT/GB96/02802; Sep. 3, 1997.
Dattilo, Philip P., Jr., et al; "Medical Textiles: Application of an Absorbable Barbed Bi-directional Surgical Suture"; Journal of Textile and Apparel, Technology and Management, vol. 2, Issue 2, Spring 2002, pp. 1-5.
Kostyuchenok, B.M., et al; "Vacuum Treatment in the Surgical Management of Purulent Wounds"; Vestnik Khirurgi, Sep. 1986, pp. 18-21 and 6 page English translation thereof.
Davydov, Yu. A., et al; "Vacuum Therapy in the Treatment of Purulent Lactation Mastitis"; Vestnik Khirurgi, May 14, 1986, pp. 66-70, and 9 page English translation thereof.
Yusupov. Yu. N., et al; "Active Wound Drainage", Vestnik Khirurgi, vol. 138, Issue 4, 1987, and 7 page English translation thereof.
Davydov, Yu. A., et al; "Bacteriological and Cytological Assessment of Vacuum Therapy for Purulent Wounds"; Vestnik Khirurgi, Oct. 1988, pp. 48-52, and 8 page English translation thereof.
Davydov, Yu. A., et al; "Concepts for the Clinical-Biological Management of the Wound Process in the Treatment of Purulent Wounds by Means of Vacuum Therapy"; Vestnik Khirurgi, Jul. 7, 1980, pp. 132-136, and 8 page English translation thereof.
Chariker, Mark E., M.D., et al; "Effective Management of incisional and cutaneous fistulae with closed suction wound drainage"; Contemporary Surgery, vol. 34, Jun. 1989, pp. 59-63.
Egnell Minor, Instruction Book, First Edition, 300 7502, Feb. 1975, pp. 24.
Egnell Minor: Addition to the Users Manual Concerning Overflow Protection—Concerns all Egnell Pumps, Feb. 3, 1983, pp. 2.
Svedman, P.: "Irrigation Treatment of Leg Ulcers", The Lancet, Sep. 3, 1983, pp. 532-534.
Chinn, Steven D. et al.: "Closed Wound Suction Drainage", The Journal of Foot Surgery, vol. 24, No. 1, 1985, pp. 76-81.
Arnljots, Björn et al.: "Irrigation Treatment in Split-Thickness Skin Grafting of Intractable Leg Ulcers", Scand J. Plast Reconstr. Surg., No. 19, 1985, pp. 211-213.
Svedman, P.: "A Dressing Allowing Continuous Treatment of a Biosurface", IRCS Medical Science: Biomedical Technology, Clinical Medicine, Surgery and Transplantation, vol. 7, 1979, p. 221.
Svedman, P. et al.: "A Dressing System Providing Fluid Supply and Suction Drainage Used for Continuous or Intermittent Irrigation", Annals of Plastic Surgery, vol. 17, No. 2, Aug. 1986, pp. 125-133.
K.F. Jeter, T.E. Tintle, and M. Chariker, "Managing Draining Wounds and Fistulae: New and Established Methods," *Chronic Wound Care*, edited by D. Krasner (Health Management Publications, Inc., King of Prussia, PA 1990), pp. 240-246.
G. Živadinović, V. Đ ukić, Ž. Maksimović, Đ . Radak, and P. Peška, "Vacuum Therapy in the Treatment of Peripheral Blood Vessels," *Timok Medical Journal* 11 (1986), pp. 161-164 (certified translation).
F.E. Johnson, "An Improved Technique for Skin Graft Placement Using a Suction Drain," *Surgery, Gynecology, and Obstetrics* 159 (1984), pp. 584-585.
A.A. Safronov, Dissertation Abstract, *Vacuum Therapy of Trophic Ulcers of the Lower Leg with Simultaneous Autoplasty of the Skin* (Central Scientific Research Institute of Traumatology and Orthopedics, Moscow, U.S.S.R. 1967) (certified translation).
M. Schein, R. Saadia, J.R. Jamieson, and G.A.G. Decker, "The 'Sandwich Technique' in the Management of the Open Abdomen," *British Journal of Surgery* 73 (1986), pp. 369-370.
D.E. Tribble, An Improved Sump Drain-Irrigation Device of Simple Construction, *Archives of Surgery* 105 (1972) pp. 511-513.
M.J. Morykwas, L.C. Argenta, E.I. Shelton-Brown, and W. McGuirt, "Vacuum-Assisted Closure: A New Method for Wound Control and Treatment: Animal Studies and Basic Foundation," *Annals of Plastic Surgery* 38 (1997), pp. 553-562 (Morykwas I).
C.E. Tennants, "The Use of Hypermia in the Postoperative Treatment of Lesions of the Extremities and Thorax, "*Journal of the American Medical Association* 64 (1915), pp. 1548-1549.
Selections from W. Meyer and V. Schmieden, *Bier's Hyperemic Treatment in Surgery, Medicine, and the Specialties: A Manual of Its Practical Application*, (W.B. Saunders Co., Philadelphia, PA 1909), pp. 17-25, 44-64, 90-96, 167-170, and 210-211.
V.A. Solovev et al., Guidelines, The Method of Treatment of Immature External Fistulas in the Upper Gastrointestinal Tract, editor-in-chief Prov. V.I. Parahonyak (S.M. Kirov Gorky State Medical Institute, Gorky, U.S.S.R. 1987) ("Solovev Guidelines").
V.A. Kuznetsov & N.A. Bagautdinov, "Vacuum and Vacuum-Sorption Treatment of Open Septic Wounds," in II All-Union Conference on Wounds and Wound Infections: Presentation Abstracts, edited by B.M. Kostyuchenok et al. (Moscow, U.S.S.R. Oct. 28-29, 1986) pp. 91-92 ("Bagautdinov II").
V.A. Solovev, Dissertation Abstract, Treatment and Prevention of Suture Failures after Gastric Resection (S.M. Kirov Gorky State Medical Institute, Gorky, U.S.S.R. 1988) ("Solovev Abstract").
V.A.C.® Therapy Clinical Guidelines: A Reference Source for Clinicians (Jul. 2007).
International Search Report and Written Opinion for PCT/US2012/051937 filed Aug. 22, 2012.

* cited by examiner 45
55
+P
CAVITY 17
MEAN CAVITY PRESSURE
t
CAVITY 16
-P
48
66
29
117'
116
229
17
232x
117
116
32
16
117'
116
228
28
70
27
229
29
32
28
228
26
40

DISC PUMP AND VALVE STRUCTURE

RELATED APPLICATIONS

The present invention claims the benefit, under 35 USC §119(e), of the filing of U.S. Provisional Patent Application Ser. No. 61/537,431, entitled "DISC PUMP AND VALVE STRUCTURE," filed Sep. 21, 2011, which is incorporated herein by reference for all purposes.

BACKGROUND OF THE INVENTION

1. Field of the Invention

The illustrative embodiments of the invention relate generally to a pump for fluid and, more specifically, to a pump in which the pumping cavity is substantially cylindrically shaped having end walls and a side wall between them with an actuator disposed between the end walls. The illustrative embodiments of the invention relate more specifically to a disc pump having a valve mounted in the actuator and at least one additional valve mounted in one of the end walls.

2. Description of Related Art

The generation of high amplitude pressure oscillations in closed cavities has received significant attention in the fields of thermo-acoustics and pump type compressors. Recent developments in non-linear acoustics have allowed the generation of pressure waves with higher amplitudes than previously thought possible.

It is known to use acoustic resonance to achieve fluid pumping from defined inlets and outlets. This can be achieved using a cylindrical cavity with an acoustic driver at one end, which drives an acoustic standing wave. In such a cylindrical cavity, the acoustic pressure wave has limited amplitude. Varying cross-section cavities, such as cone, horn-cone, bulb have been used to achieve high amplitude pressure oscillations thereby significantly increasing the pumping effect. In such high amplitude waves the non-linear mechanisms with energy dissipation have been suppressed. However, high amplitude acoustic resonance has not been employed within disc-shaped cavities in which radial pressure oscillations are excited until recently. International Patent Application No. PCT/GB2006/001487, published as WO 2006/111775, discloses a pump having a substantially disc-shaped cavity with a high aspect ratio, i.e., the ratio of the radius of the cavity to the height of the cavity.

Such a pump has a substantially cylindrical cavity comprising a side wall closed at each end by end walls. The pump also comprises an actuator that drives either one of the end walls to oscillate in a direction substantially perpendicular to the surface of the driven end wall. The spatial profile of the motion of the driven end wall is described as being matched to the spatial profile of the fluid pressure oscillations within the cavity, a state described herein as mode-matching. When the pump is mode-matched, work done by the actuator on the fluid in the cavity adds constructively across the driven end wall surface, thereby enhancing the amplitude of the pressure oscillation in the cavity and delivering high pump efficiency. The efficiency of a mode-matched pump is dependent upon the interface between the driven end wall and the side wall. It is desirable to maintain the efficiency of such pump by structuring the interface so that it does not decrease or dampen the motion of the driven end wall thereby mitigating any reduction in the amplitude of the fluid pressure oscillations within the cavity.

The actuator of the pump described above causes an oscillatory motion of the driven end wall ("displacement oscillations") in a direction substantially perpendicular to the end wall or substantially parallel to the longitudinal axis of the cylindrical cavity, referred to hereinafter as "axial oscillations" of the driven end wall within the cavity. The axial oscillations of the driven end wall generate substantially proportional "pressure oscillations" of fluid within the cavity creating a radial pressure distribution approximating that of a Bessel function of the first kind as described in International Patent Application No. PCT/GB2006/001487 which is incorporated by reference herein, such oscillations referred to hereinafter as "radial oscillations" of the fluid pressure within the cavity. A portion of the driven end wall between the actuator and the side wall provides an interface with the side wall of the pump that decreases dampening of the displacement oscillations to mitigate any reduction of the pressure oscillations within the cavity, that portion being referred to hereinafter as an "isolator" as described more specifically in U.S. patent application Ser. No. 12/477,594 which is incorporated by reference herein. The illustrative embodiments of the isolator are operatively associated with the peripheral portion of the driven end wall to reduce dampening of the displacement oscillations.

Such pumps also require one or more valves for controlling the flow of fluid through the pump and, more specifically, valves being capable of operating at high frequencies. Conventional valves typically operate at lower frequencies below 500 Hz for a variety of applications. For example, many conventional compressors typically operate at 50 or 60 Hz. Linear resonance compressors known in the art operate between 150 and 350 Hz. However, many portable electronic devices including medical devices require pumps for delivering a positive pressure or providing a vacuum that are relatively small in size and it is advantageous for such pumps to be inaudible in operation so as to provide discrete operation. To achieve these objectives, such pumps must operate at very high frequencies requiring valves capable of operating at about 20 kHz and higher. To operate at these high frequencies, the valve must be responsive to a high frequency oscillating pressure that can be rectified to create a net flow of fluid through the pump.

Such a valve is described more specifically in International Patent Application No. PCT/GB2009/050614 which is incorporated by reference herein. Valves may be disposed in either the first or second aperture, or both apertures, for controlling the flow of fluid through the pump. Each valve comprises a first plate having apertures extending generally perpendicular therethrough and a second plate also having apertures extending generally perpendicular therethrough, wherein the apertures of the second plate are substantially offset from the apertures of the first plate. The valve further comprises a sidewall disposed between the first and second plate, wherein the sidewall is closed around the perimeter of the first and second plates to form a cavity between the first and second plates in fluid communication with the apertures of the first and second plates. The valve further comprises a flap disposed and moveable between the first and second plates, wherein the flap has apertures substantially offset from the apertures of the first plate and substantially aligned with the apertures of the second plate. The flap is motivated between the first and second plates in response to a change in direction of the differential pressure of the fluid across the valve.

SUMMARY

A design for an actuator-mounted valve is disclosed, suitable for controlling the flow of fluid at high frequencies under the vibration it is subjected to during operation when located within the driven end-wall of the pump cavity described above.

The general construction of a valve suitable for operation at high frequencies is described in related International Patent Application No PCT/GB2009/050614, which is incorporated herein by reference. The illustrative embodiments of the invention relate to a disc pump having a dual-cavity structure including a common interior wall between the cavities of the pump.

More specifically, one preferred embodiment of the pump comprises a pump body having a substantially elliptically shaped side wall closed by two end walls, and a pair of internal plates adjacent each other and supported by the side wall to form two cavities within said pump body for containing fluids. Each cavity has a height (h) and a radius (r), wherein a ratio of the radius (r) to the height (h) is greater than about 1.2.

This pump also comprises an actuator formed by the internal plates wherein one of the internal plates is operatively associated with a central portion of the other internal plate and adapted to cause an oscillatory motion thereby generating radial pressure oscillations of the fluid within each of the cavities including at least one annular pressure node in response to a drive signal being applied to the actuator when in use.

The pump further comprises a first aperture extending through the actuator to enable the fluid to flow from one cavity to the other cavity with a first valve disposed in said first aperture to control the flow of fluid through the first aperture. The pump further comprises a second aperture extending through a first one of the end walls to enable the fluid to flow through the cavity adjacent the first one of the end walls with a second valve disposed in the second aperture to control the flow of fluid through the second aperture.

The pump further comprises a third aperture extending through a second one of the end walls to enable the fluid to flow through the cavity adjacent the second one of the end walls, whereby fluids flow into one cavity and out the other cavity when in use. The pump may further comprise a third valve disposed in the third aperture to control the flow of fluid through the third aperture when in use.

Other objects, features, and advantages of the illustrative embodiments are disclosed herein and will become apparent with reference to the drawings and detailed description that follow.

DETAILED DESCRIPTION OF ILLUSTRATIVE EMBODIMENTS

In the following detailed description of several illustrative embodiments, reference is made to the accompanying drawings that form a part hereof, and in which is shown by way of illustration specific preferred embodiments in which the invention may be practiced. These embodiments are described in sufficient detail to enable those skilled in the art to practice the invention, and it is understood that other embodiments may be utilized and that logical structural, mechanical, electrical, and chemical changes may be made without departing from the spirit or scope of the invention. To avoid detail not necessary to enable those skilled in the art to practice the embodiments described herein, the description may omit certain information known to those skilled in the art. The following detailed description is, therefore, not to be taken in a limiting sense, and the scope of the illustrative embodiments are defined only by the appended claims.

Figure 1A:
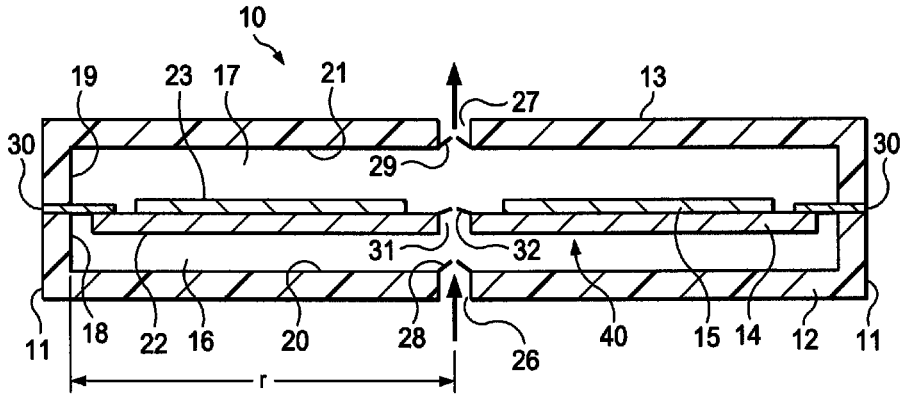
FIG. 1A shows a schematic, cross-section view of a first pump according to an illustrative embodiment of the invention.
Figure 1B:
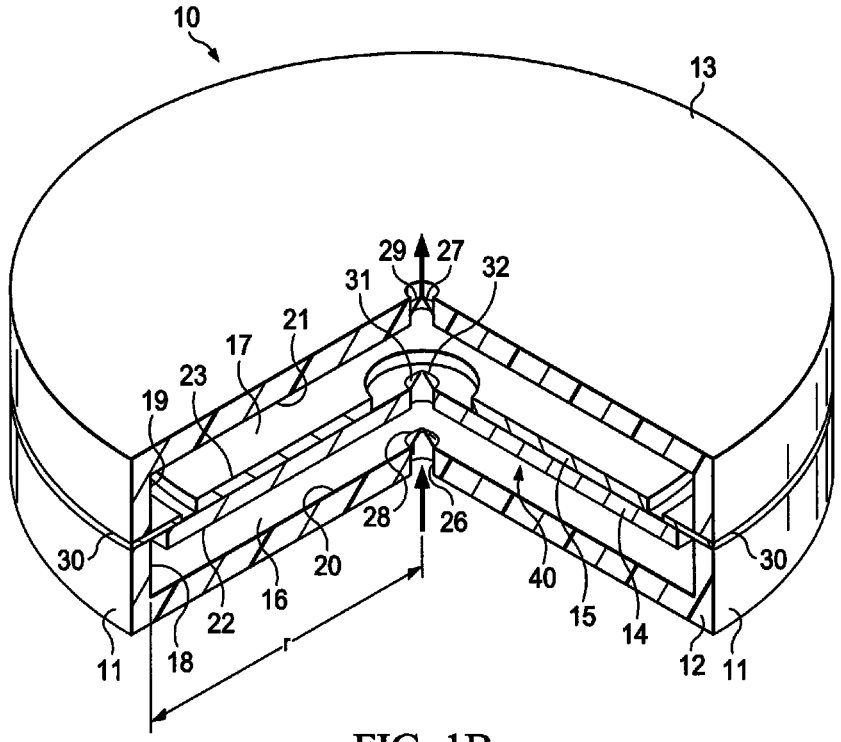
FIG. 1B shows a schematic, perspective view of the first pump of FIG. 1A.
Figure 1C:
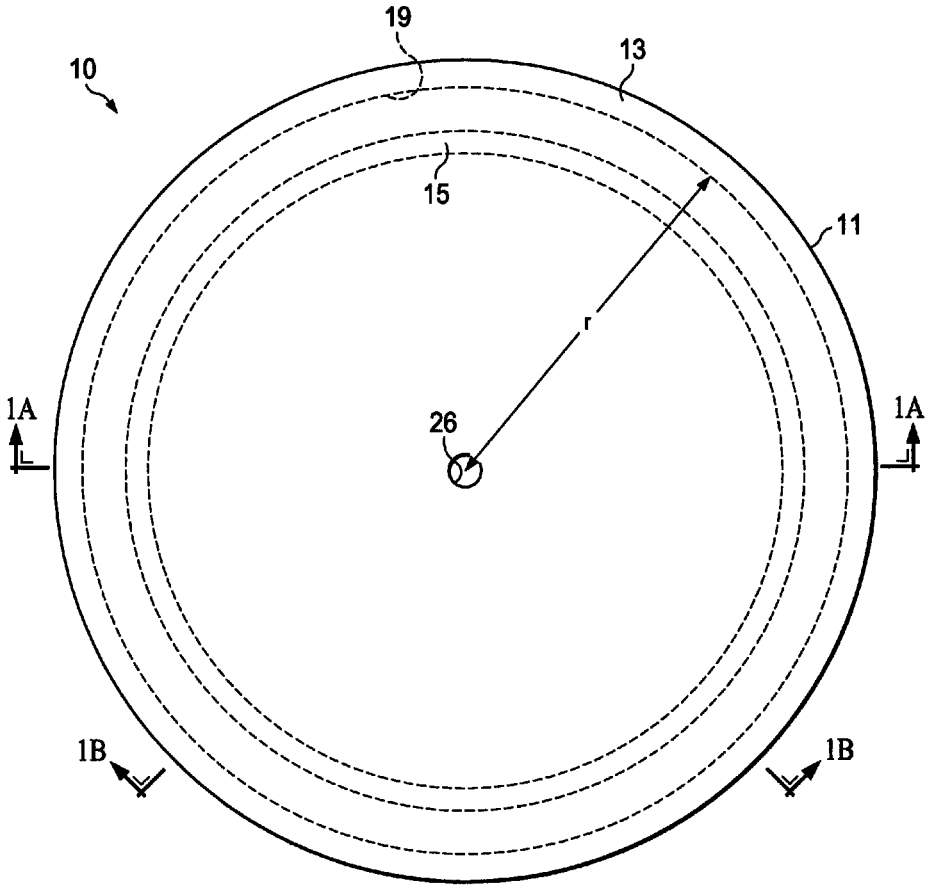
FIG. 1C shows a schematic, cross-section view of the first pump of FIG. 1A taken along line 1C-1C in FIG. 1A.

FIG. 1A is a schematic cross-section view of a pump 10 according to an illustrative embodiment of the invention. Referring also to FIGS. 1B and 1C, the pump 10 comprises a pump body having a substantially elliptical shape including a cylindrical wall 11 closed at each end by end plates 12, 13. The pump 10 further comprises a pair of disc-shaped interior plates 14, 15 supported within the pump 10 by a ring-shaped isolator 30 affixed to the cylindrical wall 11 of the pump body. The internal surfaces of the cylindrical wall 11, the end plate 12, the interior plate 14, and the ring-shaped isolator 30 form a first cavity 16 within the pump 10, and the internal surfaces of the cylindrical wall 11, the end plate 13, the interior plate 15, and the ring-shaped isolator 30 form a second cavity 17 within the pump 10. The internal surfaces of the first cavity 16 comprise a side wall 18 which is a first portion of the inside surface of the cylindrical wall 11 that is closed at both ends by end walls 20, 22 wherein the end wall 20 is the internal surface of the end plate 12 and the end wall 22 comprises the internal surface of the interior plate 14 and a first side of the isolator 30. The end wall 22 thus comprises a central portion corresponding to the inside surface of the interior plate 14 and a peripheral portion corresponding to the inside surface of the ring-shaped isolator 30. The internal surfaces of the second cavity 17 comprise a side wall 19 which is a second portion of the inside surface of the cylindrical wall 11 that is closed at both ends by end walls 21, 23 wherein the end wall 21 is the internal surface of the end plate 13 and the end wall 23 comprises the internal surface of the interior plate 15 and a second side of the isolator 30. The end wall 23 thus comprises a central portion corresponding to the inside surface of the interior plate 15 and a peripheral portion corresponding to the inside surface of the ring-shaped isolator 30. Although the pump 10 and its components are substantially elliptical in shape, the specific embodiment disclosed herein is a circular, elliptical shape.

Figure 2A:
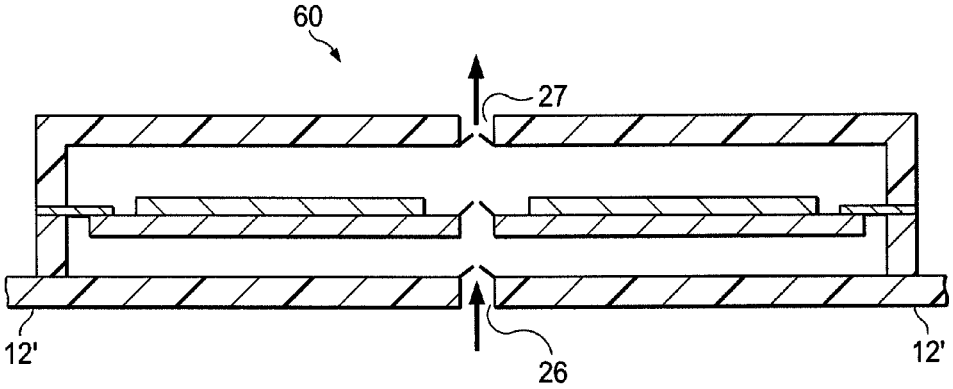
FIG. 2A shows a schematic, cross-section view of a second pump according to an illustrative embodiment of the invention.
Figure 2B:
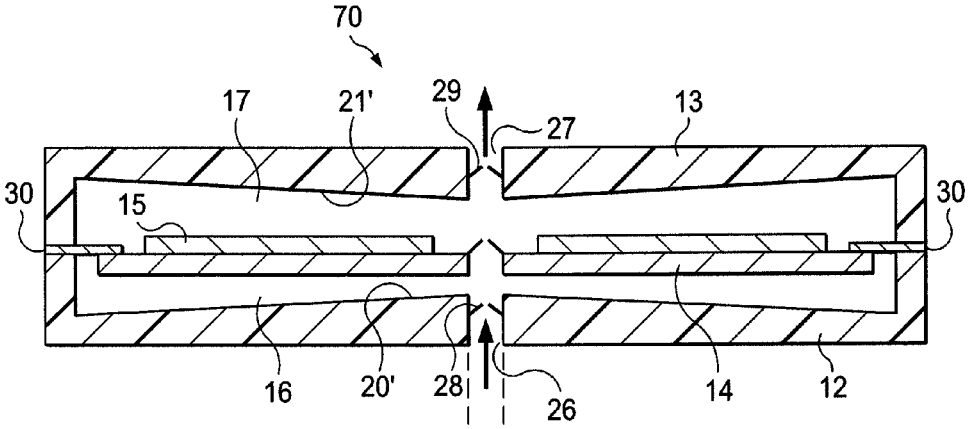
FIG. 2B shows a schematic, cross-section view of a third pump according to an illustrative embodiment of the invention.

The cylindrical wall 11 and the end plates 12, 13 may be a single component comprising the pump body as shown in FIG. 1A or separate components such as the pump body of a pump 60 shown in FIG. 2A wherein the end plate 12 is formed by a separate substrate 12' that may be an assembly board or printed wire assembly (PWA) on which the pump 60 is mounted. Although the cavity 11 is substantially circular in shape, the cavity 11 may also be more generally elliptical in shape. In the embodiments shown in FIGS. 1A and 2A, the end walls defining the cavities 16, 17 are shown as being generally planar and parallel. However the end walls 12, 13 defining the inside surfaces of the cavities 16, 17, respectively, may also include frusto-conical surfaces. Referring more specifically to FIG. 2B, pump 70 comprises frusto-conical surfaces 20', 21' as described in more detail in the WO2006/111775 publication which is incorporated by reference herein. The end plates 12, 13 and cylindrical wall 11 of the pump body may be formed from any suitable rigid material including, without limitation, metal, ceramic, glass, or plastic including, without limitation, inject-molded plastic.

The interior plates 14, 15 of the pump 10 together form an actuator 40 that is operatively associated with the central portion of the end walls 22, 23 which are the internal surfaces of the cavities 16, 17 respectfully. One of the interior plates 14, 15 must be formed of a piezoelectric material which may include any electrically active material that exhibits strain in response to an applied electrical signal, such as, for example, an electrostrictive or magnetostrictive material. In one preferred embodiment, for example, the interior plate 15 is formed of piezoelectric material that that exhibits strain in response to an applied electrical signal, i.e., the active interior plate. The other one of the interior plates 14,15 preferably possess a bending stiffness similar to the active interior plate and may be formed of a piezoelectric material or an electrically inactive material, such as a metal or ceramic. In this preferred embodiment, the interior plate 14 possess a bending stiffness similar to the active interior plate 15 and is formed of an electrically inactive material, such as a metal or ceramic, i.e., the inert interior plate. When the active interior plate 15 is excited by an electrical current, the active interior plate 15 expands and contracts in a radial direction relative to the longitudinal axis of the cavities 16, 17 causing the interior plates 14, 15 to bend, thereby inducing an axial deflection of their respective end walls 22, 23 in a direction substantially perpendicular to the end walls 22, 23 (See FIG. 4A).

In other embodiments not shown, the isolator 30 may support either one of the interior plates 14, 15, whether the active or inert internal plate, from the top or the bottom surfaces depending on the specific design and orientation of the pump 10. In another embodiment, the actuator 40 may be replaced by a device in a force-transmitting relation with only one of the interior plates 14, 15 such as, for example, a mechanical, magnetic or electrostatic device, wherein the interior plate may be formed as an electrically inactive or passive layer of material driven into oscillation by such device (not shown) in the same manner as described above.

The pump 10 further comprises at least one aperture extending from each of the cavities 16, 17 to the outside of the pump 10, wherein at least one of the apertures contain a valve to control the flow of fluid through the aperture. Although the apertures may be located at any position in the cavities 16, 17 where the actuator 40 generates a pressure differential as described below in more detail, one embodiment of the pump 10 shown in FIGS. 1A-1C comprises an inlet aperture 26 and an outlet aperture 27, each one located at approximately the centre of and extending through the end plates 12, 13. The apertures 26, 27 contain at least one end valve. In one preferred embodiment, the apertures 26, 27 contain end valves 28, 29 which regulate the flow of fluid in one direction as indicated by the arrows so that end valve 28 functions as an inlet valve for the pump 10 while valve 29 functions as an outlet valve for the pump 10. Any reference to the apertures 26, 27 that include the end valves 28, 29 refers to that portion of the openings outside of the end valves 28, 29, i.e., outside the cavities 16, 17, respectively, of the pump 10.

The pump 10 further comprises at least one aperture extending between the cavities 16, 17 through the actuator 40, wherein at least one of the apertures contains a valve to control the flow of fluid through the aperture. Although these apertures may be located at any position on the actuator 40 between the cavities 16, 17 where the actuator 40 generates a pressure differential as described below in more detail, one preferred embodiment of the pump 10 shown in FIGS. 1A-1C comprises an actuator aperture 31 located at approximately the centre of and extending through the interior plates 14, 15. The actuator aperture 31 contains an actuator valve 32 which regulates the flow of fluid in one direction between the cavities 16, 17 (in this embodiment from the first cavity 16 to the second cavity 17) as indicated by the arrow so that the actuator valve 32 functions as an outlet valve from the first cavity 16 and as an inlet valve to the second cavity 17. The actuator valve 32 enhances the output of the pump 10 by augmenting the flow of fluid between the cavities 16, 17 and supplementing the operation of the inlet valve 26 in conjunction with the outlet valve 27 as described in more detail below.

The dimensions of the cavities 16, 17 described herein should each preferably satisfy certain inequalities with respect to the relationship between the height (h) of the cavities 16, 17 and their radius (r) which is the distance from the longitudinal axis of the cavities 16, 17 to the side walls 18, 19. These equations are as follows:

$$r/h>1.2; \text{ and}$$

$$h^2/r>4\times10^{-10} \text{ meters.}$$

In one embodiment of the invention, the ratio of the cavity radius to the cavity height (r/h) is between about 10 and about 50 when the fluid within the cavities 16, 17 is a gas. In this example, the volume of the cavities 16, 17 may be less than about 10 ml. Additionally, the ratio of $h^2/r$ is preferably within a range between about $10^{-6}$ and about $10^{-7}$ meters where the working fluid is a gas as opposed to a liquid.

Additionally, each of the cavities 16, 17 disclosed herein should preferably satisfy the following inequality relating the cavity radius (r) and operating frequency (f) which is the frequency at which the actuator 40 vibrates to generate the axial displacement of the end walls 22, 23. The inequality equation is as follows:

$$\frac{k_0(c_s)}{2\pi f} \le r \le \frac{k_0(c_f)}{2\pi f} \qquad \text{[Equation 1]}$$

wherein the speed of sound in the working fluid within the cavities 16, 17 (c) may range between a slow speed ($c_s$) of about 115 m/s and a fast speed (CO equal to about 1,970 m/s as expressed in the equation above, and $k_0$ is a constant ($k_0$=3.83). The frequency of the oscillatory motion of the actuator 40 is preferably about equal to the lowest resonant frequency of radial pressure oscillations in the cavities 16, 17 , but may be within 20% that value. The lowest resonant frequency of radial pressure oscillations in the cavity 11 is preferably greater than about 500 Hz.

Although it is preferable that each of the cavities 16, 17 disclosed herein should satisfy individually the inequalities identified above, the relative dimensions of the cavities 16, 17 should not be limited to cavities having the same height and radius. For example, each of the cavities 16, 17 may have a slightly different shape requiring different radii or heights creating different frequency responses so that the two cavities 14, 15 resonate in a desired fashion to generate the optimal output from the pump 10.

In operation, the pump 10 may function as a source of positive pressure adjacent the outlet valve 27 to pressurize a load (not shown) or as a source of negative or reduced pressure adjacent the inlet valve 26 to depressurize a load (not shown) as illustrated by the arrows. For example, the load may be a tissue treatment system that utilizes negative pressure for treatment. The term "reduced pressure" as used herein generally refers to a pressure less than the ambient pressure where the pump 10 is located. Although the term "vacuum" and "negative pressure" may be used to describe the reduced pressure, the actual pressure reduction may be significantly less than the pressure reduction normally associated with a complete vacuum. The pressure is "negative" in the sense that it is a gauge pressure, i.e., the pressure is reduced below ambient atmospheric pressure. Unless otherwise indicated, values of pressure stated herein are gauge pressures. References to increases in reduced pressure typically refer to a decrease in absolute pressure, while decreases in reduced pressure typically refer to an increase in absolute pressure.

Figure 3:
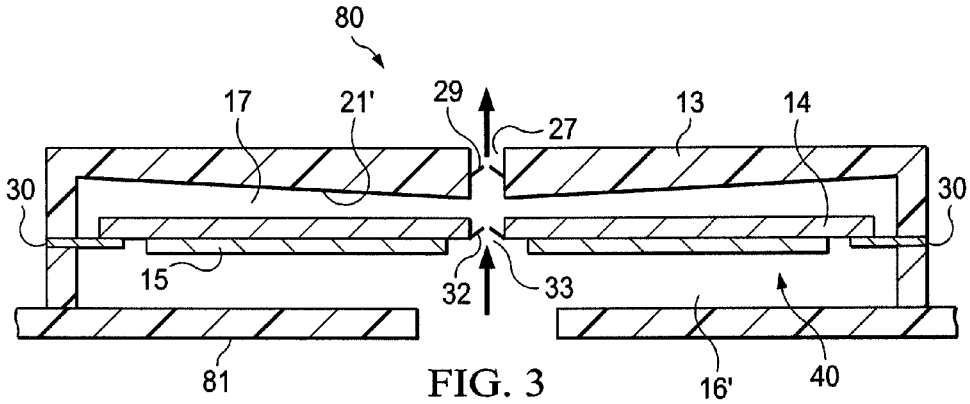
FIG. 3 shows a schematic, cross-section view of a fourth pump according to an illustrative embodiment of the invention.

As indicated above, the pump 10 comprises at least one actuator valve 32 and at least one end valve, i.e., one of the end valves 28, 29. For example, the pump 70 may comprise only one of the end valves 28, 29 leaving the other one of the apertures 26, 27 open. Additionally, either one of the end walls 12, 13 may be removed completely to eliminate one of the cavities 16, 17 along with one of the end valves 28, 29. Referring more specifically to FIG. 3, pump 80 includes only one end wall and cavity, i.e., end wall 13 and cavity 17, with only one end valve, i.e., end valve 29 contained within the outlet aperture 27. In this embodiment, the actuator valve 32 functions as an inlet for the pump 80 so that the aperture extending through the actuator 40 serves as an inlet aperture 33 as shown by the arrow. The actuator 40 of the pump 80 is oriented such that the position of the interior plates 14, 15 are reversed with the interior plate 14 positioned inside the cavity 17. However, if the pump 80 is positioned on any substrate such as, for example, a printed circuit board 81, a secondary cavity 16' may be formed with the active interior plate 15 positioned therein.

Figure 4A:
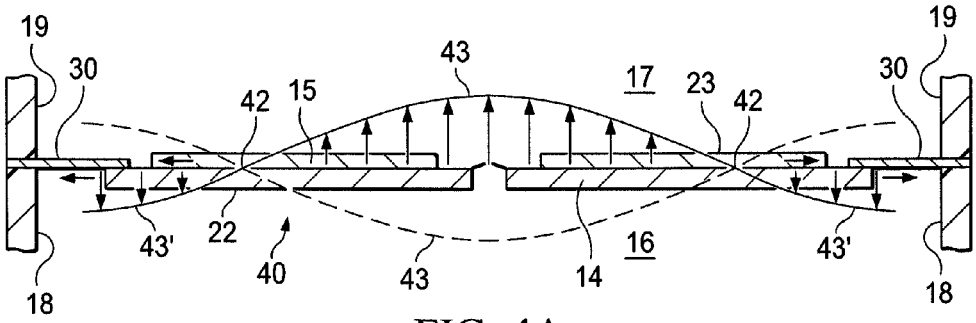
FIG. 4A shows a graph of the axial displacement oscillations for the fundamental bending mode of an actuator of the first pump of FIG. 1A.

FIG. 4A shows one possible displacement profile illustrating the axial oscillation of the driven end walls 22, 23 of the respective cavities 16, 17. The solid curved line and arrows represent the displacement of the driven end wall 23 at one point in time, and the dashed curved line represents the displacement of the driven end wall 23 one half-cycle later. The displacement as shown in this figure and the other figures is exaggerated. Because the actuator 40 is not rigidly mounted at its perimeter, but rather suspended by the ring-shaped isolator 30, the actuator 40 is free to oscillate about its centre of mass in its fundamental mode. In this fundamental mode, the amplitude of the displacement oscillations of the actuator 40 is substantially zero at an annular displacement node 42 located between the centre of the driven end walls 22, 23 and the side walls 18, 19. The amplitudes of the displacement oscillations at other points on the end wall 12 are greater than zero as represented by the vertical arrows. A central displacement anti-node 43 exists near the centre of the actuator 40 and a peripheral displacement anti-node 43' exists near the perimeter of the actuator 40. The central displacement anti-node 43 is represented by the dashed curve after one half-cycle.

Figure 4B:
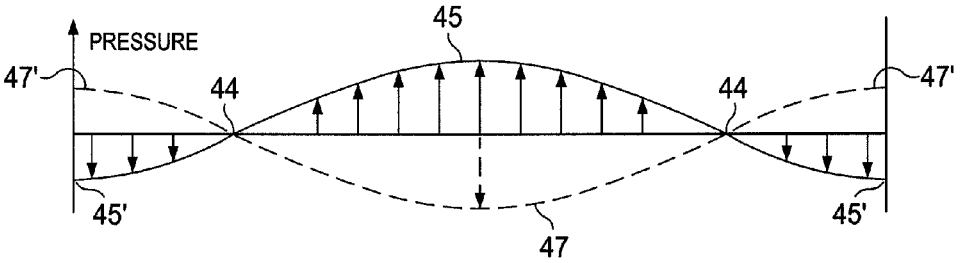
FIG. 4B shows a graph of the pressure oscillations of fluid within the cavity of the first pump of FIG. 1A in response to the bending mode shown in FIG. 4A.

FIG. 4B shows one possible pressure oscillation profile illustrating the pressure oscillation within each one of the cavities 16, 17 resulting from the axial displacement oscillations shown in FIG. 4A. The solid curved line and arrows represent the pressure at one point in time. In this mode and higher-order modes, the amplitude of the pressure oscillations has a positive central pressure anti-node 45 near the centre of the cavity 17 and a peripheral pressure anti-node 45' near the side wall 18 of the cavity 16. The amplitude of the pressure oscillations is substantially zero at the annular pressure node 44 between the central pressure anti-node 45 and the peripheral pressure anti-node 45'. At the same time, the amplitude of the pressure oscillations as represented by the dashed line has a negative central pressure anti-node 47 near the centre of the cavity 16 with a peripheral pressure anti-node 47' and the same annular pressure node 44. For a cylindrical cavity, the radial dependence of the amplitude of the pressure oscillations in the cavities 16, 17 may be approximated by a Bessel function of the first kind. The pressure oscillations described above result from the radial movement of the fluid in the cavities 16, 17 and so will be referred to as the "radial pressure oscillations" of the fluid within the cavities 16, 17 as distinguished from the axial displacement oscillations of the actuator 40.

With further reference to FIGS. 4A and 4B, it can be seen that the radial dependence of the amplitude of the axial displacement oscillations of the actuator 40 (the "mode-shape" of the actuator 40) should approximate a Bessel function of the first kind so as to match more closely the radial dependence of the amplitude of the desired pressure oscillations in each one of the cavities 16, 17 (the "mode-shape" of the pressure oscillation). By not rigidly mounting the actuator 40 at its perimeter and allowing it to vibrate more freely about its centre of mass, the mode-shape of the displacement oscillations substantially matches the mode-shape of the pressure oscillations in the cavities 16, 17 thus achieving mode-shape matching or, more simply, mode-matching. Although the mode-matching may not always be perfect in this respect, the axial displacement oscillations of the actuator 40 and the corresponding pressure oscillations in the cavities 16, 17 have substantially the same relative phase across the full surface of the actuator 40 wherein the radial position of the annular pressure node 44 of the pressure oscillations in the cavities 16, 17 and the radial position of the annular displacement node 42 of the axial displacement oscillations of actuator 40 are substantially coincident.

As the actuator 40 vibrates about its centre of mass, the radial position of the annular displacement node 42 will necessarily lie inside the radius of the actuator 40 when the actuator 40 vibrates in its fundamental bending mode as illustrated in FIG. 4A. Thus, to ensure that the annular displacement node 42 is coincident with the annular pressure node 44, the radius of the actuator ($r_{act}$) should preferably be greater than the radius of the annular pressure node 44 to optimize mode-matching. Assuming again that the pressure oscillation in the cavities 16, 17 approximates a Bessel function of the first kind, the radius of the annular pressure node 44 would be approximately 0.63 of the radius from the centre of the end walls 22, 23 to the side walls 18, 19, i.e., the radius of the cavities 16, 17 ("r"), as shown in FIG. 1A. Therefore, the radius of the actuator 40 ($r_{act}$) should preferably satisfy the following inequality: $r_{act} \geq 0.63r$.

The ring-shaped isolator 30 may be a flexible membrane which enables the edge of the actuator 40 to move more freely as described above by bending and stretching in response to the vibration of the actuator 40 as shown by the displacement at the peripheral displacement anti-node 43' in FIG. 4A. The flexible membrane overcomes the potential dampening effects of the side walls 18, 19 on the actuator 40 by providing a low mechanical impedance support between the actuator 40 and the cylindrical wall 11 of the pump 10 thereby reducing the dampening of the axial oscillations at the peripheral displacement anti-node 43' of the actuator 40. Essentially, the flexible membrane minimizes the energy being transferred from the actuator 40 to the side walls 18, 19 with the outer peripheral edge of the flexible membrane remaining substantially stationary. Consequently, the annular displacement node 42 will remain substantially aligned with the annular pressure node 44 so as to maintain the mode-matching condition of the pump 10. Thus, the axial displacement oscillations of the driven end walls 22, 23 continue to efficiently generate oscillations of the pressure within the cavities 16, 17 from the central pressure anti-nodes 45, 47 to the peripheral pressure anti-nodes 45', 47' at the side walls 18, 19 as shown in FIG. 4B.

Figure 5A:
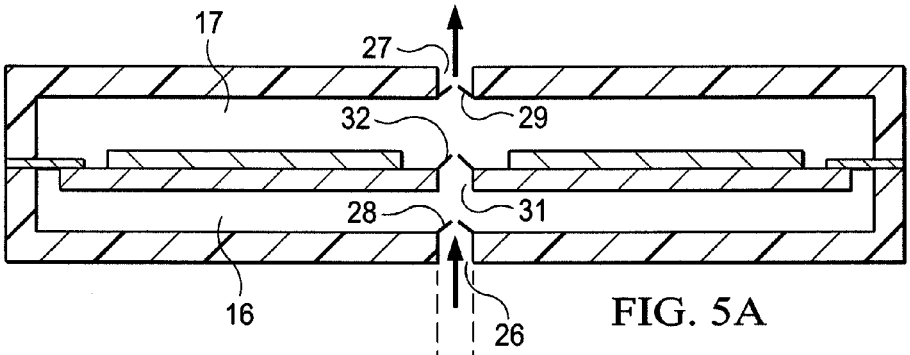
FIG. 5A shows a schematic, cross-section view of the first pump of FIG. 1A wherein the three valves are represented by a single valve illustrated in FIGS. 7A-7D.
Figure 5B:
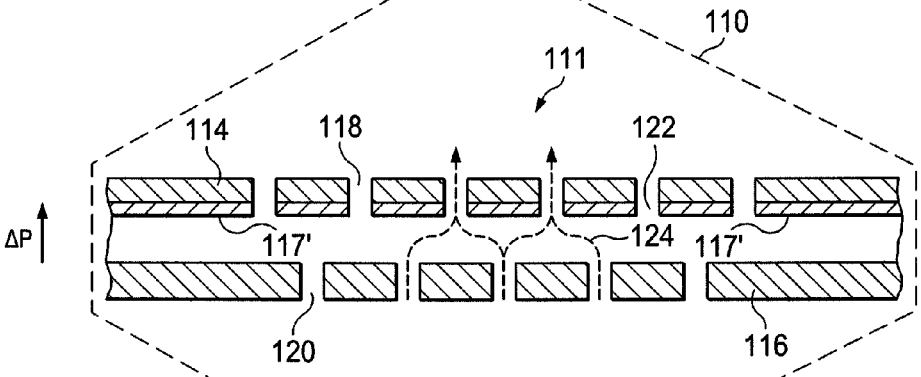
FIG. 5B shows a schematic, cross-sectional, exploded view of a center portion of the valve of FIGS. 7A-7D
Figure 6:
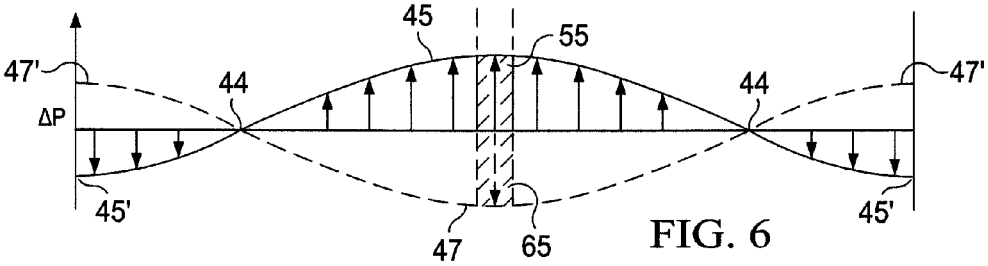
FIG. 6 shows a graph of pressure oscillations of fluid of within the cavities of the first pump of FIG. 5A as shown in FIG. 4B to illustrate the pressure differential applied across the valve of FIG. 5A as indicated by the dashed lines.

Referring to FIG. 5A, the pump 10 of FIG. 1A is shown with the valves 28, 29, 32, all of which are substantially similar in structure as represented, for example, by a valve 110 shown in FIGS. 7A-7D and having a center portion 111 shown in FIG. 5B. The following description associated with FIGS. 5-9 are all based on the function of a single valve 110 that may be positioned in any one of the apertures 26, 27, 31 of the pump 10 or pumps 60, 70, or 80. FIG. 6 shows a graph of the pressure oscillations of fluid within the pump 10 as shown in FIG. 4B. The valve 110 allows fluid to flow in only one direction as described above. The valve 110 may be a check valve or any other valve that allows fluid to flow in only one direction. Some valve types may regulate fluid flow by switching between an open and closed position. For such valves to operate at the high frequencies generated by the actuator 40, the valves 28, 29, 32 must have an extremely fast response time such that they are able to open and close on a timescale significantly shorter than the timescale of the pressure variation. One embodiment of the valves 28, 29, 32 achieves this by employing an extremely light flap valve which has low inertia and consequently is able to move rapidly in response to changes in relative pressure across the valve structure.

Referring to FIGS. 7A-D and 5B, valve 110 referred to above is such a flap valve for the pump 10 according to an illustrative embodiment. The valve 110 comprises a substantially cylindrical wall 112 that is ring-shaped and closed at one end by a retention plate 114 and at the other end by a sealing plate 116. The inside surface of the wall 112, the retention plate 114, and the sealing plate 116 form a cavity 115 within the valve 110. The valve 110 further comprises a substantially circular flap 117 disposed between the retention plate 114 and the sealing plate 116, but adjacent the sealing plate 116. The circular flap 117 may be disposed adjacent the retention plate 114 in an alternative embodiment as will be described in more detail below, and in this sense the flap 117 is considered to be "biased" against either one of the sealing plate 116 or the retention plate 114. The peripheral portion of the flap 117 is sandwiched between the sealing plate 116 and the ring-shaped wall 112 so that the motion of the flap 117 is restrained in the plane substantially perpendicular the surface of the flap 117. The motion of the flap 117 in such plane may also be restrained by the peripheral portion of the flap 117 being attached directly to either the sealing plate 116 or the wall 112, or by the flap 117 being a close fit within the ring-shaped wall 112, in an alternative embodiment. The remainder of the flap 117 is sufficiently flexible and movable in a direction substantially perpendicular to the surface of the flap 117, so that a force applied to either surface of the flap 117 will motivate the flap 117 between the sealing plate 116 and the retention plate 114.

The retention plate 114 and the sealing plate 116 both have holes 118 and 120, respectively, which extend through each plate. The flap 117 also has holes 122 that are generally aligned with the holes 118 of the retention plate 114 to provide a passage through which fluid may flow as indicated by the dashed arrows 124 in FIGS. 5B and 8A. The holes 122 in the flap 117 may also be partially aligned, i.e., having only a partial overlap, with the holes 118 in the retention plate 114. Although the holes 118, 120, 122 are shown to be of substantially uniform size and shape, they may be of different diameters or even different shapes without limiting the scope of the invention. In one embodiment of the invention, the holes 118 and 120 form an alternating pattern across the surface of the plates as shown by the solid and dashed circles, respectively, in FIG. 7D. In other embodiments, the holes 118, 120, 122 may be arranged in different patterns without effecting the operation of the valve 110 with respect to the functioning of the individual pairings of holes 118, 120, 122 as illustrated by individual sets of the dashed arrows 124. The pattern of holes 118, 120, 122 may be designed to increase or decrease the number of holes to control the total flow of fluid through the valve 110 as required. For example, the number of holes 118, 120, 122 may be increased to reduce the flow resistance of the valve 110 to increase the total flow rate of the valve 110.

Figure 7A:
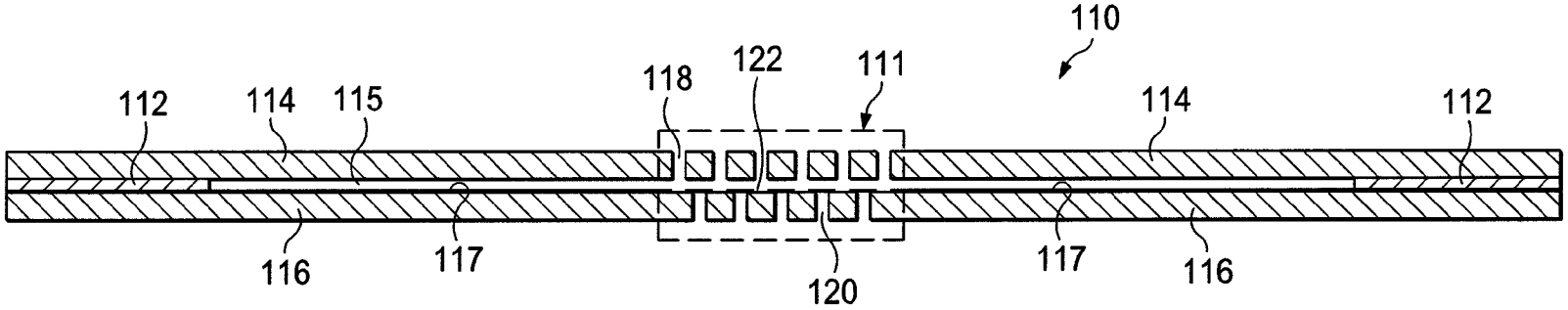
FIG. 7A shows a schematic, cross-section view of an illustrative embodiment of a valve in a closed position.
Figure 7B:
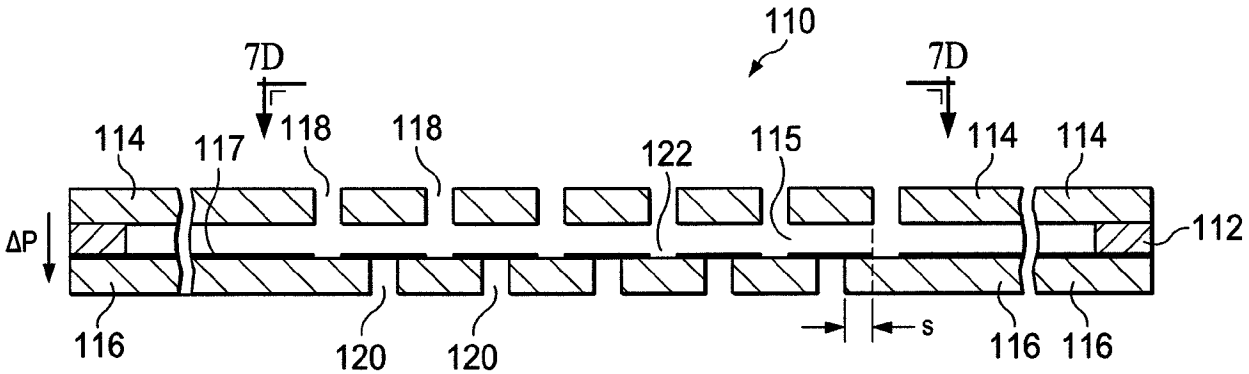
FIG. 7B shows an exploded, sectional view of the valve of FIG. 7A taken along line 7B-7B in FIG. 7D.
Figure 7C:
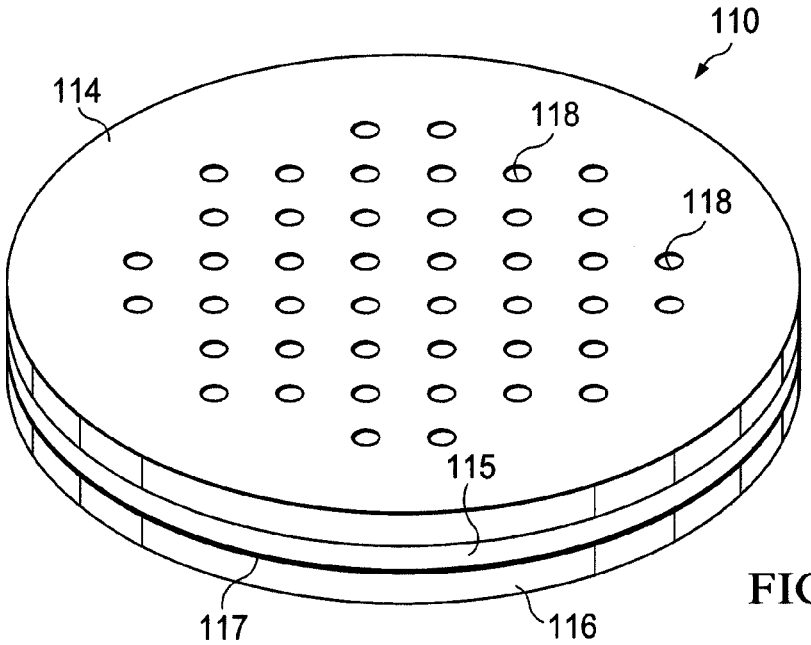
FIG. 7C shows a schematic, perspective view of the valve of FIG. 7B.
Figure 7D:
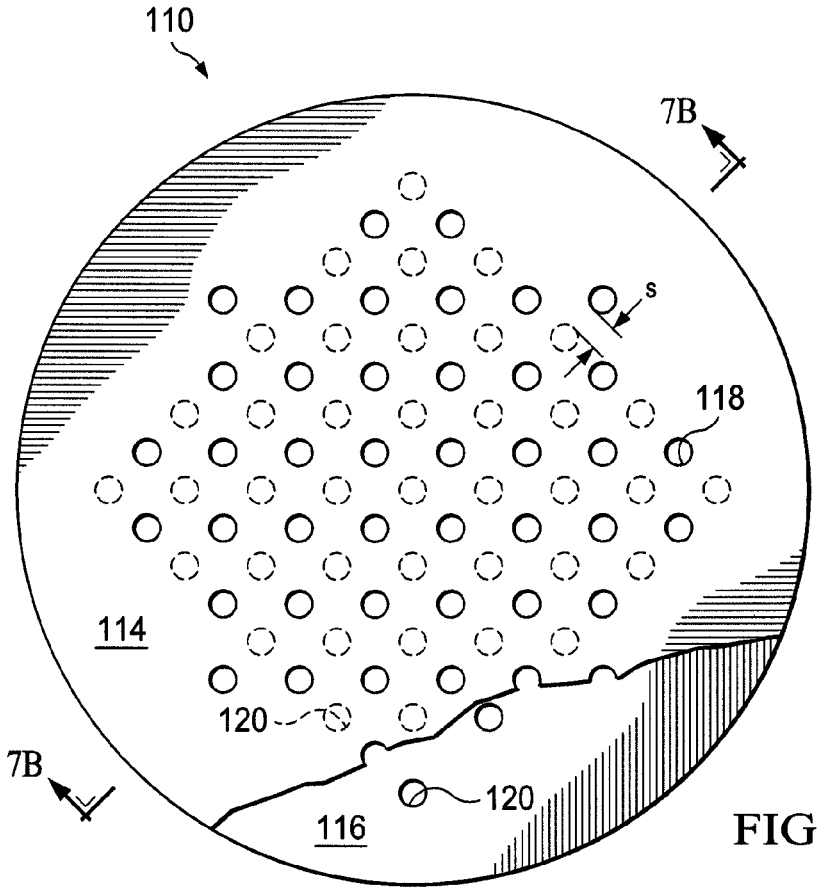
FIG. 7D shows a schematic, top view of the valve of FIG. 7B.
Figure 8A:
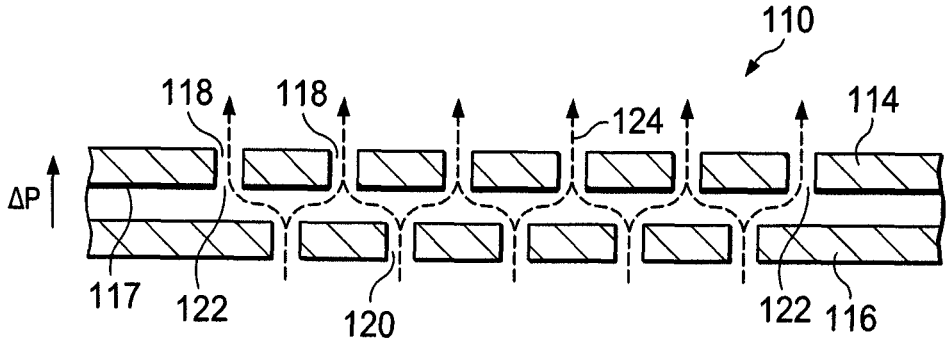
FIG. 8A shows a schematic, cross-section view of the valve in FIG. 7B in an open position when fluid flows through the valve.
Figure 8B:
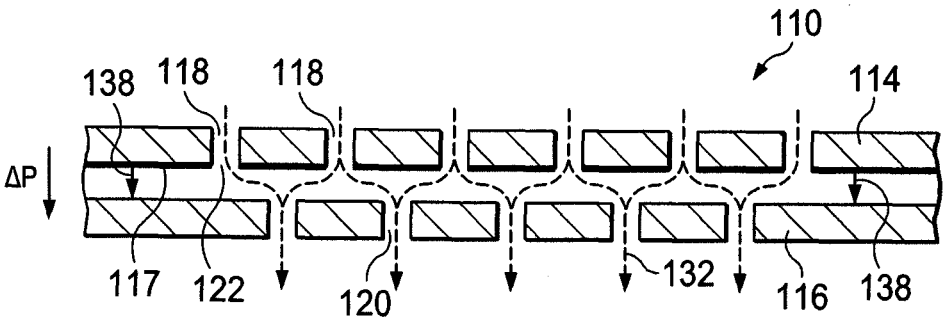
FIG. 8B shows a schematic, cross-section view of the valve in FIG. 7B in transition between the open and closed positions before closing.
Figure 8C:
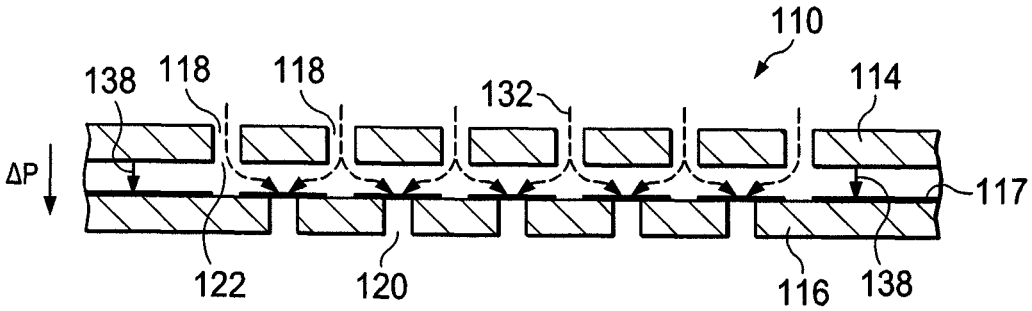
FIG. 8C shows a schematic, cross-section view of the valve of FIG. 7B in a closed position when fluid flow is blocked by the valve.

Referring also to FIGS. 8A-8C, the center portion 111 of the valve 110 illustrates how the flap 117 is motivated between the sealing plate 116 and the retention plate 114 when a force applied to either surface of the flap 117. When no force is applied to either surface of the flap 117 to overcome the bias of the flap 117, the valve 110 is in a "normally closed" position because the flap 117 is disposed adjacent the sealing plate 116 where the holes 122 of the flap are offset or not aligned with the holes 118 of the sealing plate 116. In this "normally closed" position, the flow of fluid through the sealing plate 116 is substantially blocked or covered by the non-perforated portions of the flap 117 as shown in FIGS. 7A and 7B. When pressure is applied against either side of the flap 117 that overcomes the bias of the flap 117 and motivates the flap 117 away from the sealing plate 116 towards the retention plate 114 as shown in FIGS. 5B and 8A, the valve 110 moves from the normally closed position to an "open" position over a time period, i.e., an opening time delay ($T_o$), allowing fluid to flow in the direction indicated by the dashed arrows 124. When the pressure changes direction as shown in FIG. 8B, the flap 117 will be motivated back towards the sealing plate 116 to the normally closed position. When this happens, fluid will flow for a short time period, i.e., a closing time delay ($T_c$), in the opposite direction as indicated by the dashed arrows 132 until the flap 117 seals the holes 120 of the sealing plate 116 to substantially block fluid flow through the sealing plate 116 as shown in FIG. 8C. In other embodiments of the invention, the flap 117 may be biased against the retention plate 114 with the holes 118, 122 aligned in a "normally open" position. In this embodiment, applying positive pressure against the flap 117 will be necessary to motivate the flap 117 into a "closed" position. Note that the terms "sealed" and "blocked" as used herein in relation to valve operation are intended to include cases in which substantial (but incomplete) sealing or blockage occurs, such that the flow resistance of the valve is greater in the "closed" position than in the "open" position.

The operation of the valve 110 is a function of the change in direction of the differential pressure (ΔP) of the fluid across the valve 110. In FIG. 8B, the differential pressure has been assigned a negative value (−ΔP) as indicated by the downward pointing arrow. When the differential pressure has a negative value (−ΔP), the fluid pressure at the outside surface of the retention plate 114 is greater than the fluid pressure at the outside surface of the sealing plate 116. This negative differential pressure (−ΔP) drives the flap 117 into the fully closed position as described above wherein the flap 117 is pressed against the sealing plate 116 to block the holes 120 in the sealing plate 116, thereby substantially preventing the flow of fluid through the valve 110. When the differential pressure across the valve 110 reverses to become a positive differential pressure (+ΔP) as indicated by the upward pointing arrow in FIG. 8A, the flap 117 is motivated away from the sealing plate 116 and towards the retention plate 114 into the open position. When the differential pressure has a positive value (+ΔP), the fluid pressure at the outside surface of the sealing plate 116 is greater than the fluid pressure at the outside surface of the retention plate 114. In the open position, the movement of the flap 117 unblocks the holes 120 of the sealing plate 116 so that fluid is able to flow through them and the aligned holes 122 and 118 of the flap 117 and the retention plate 114, respectively, as indicated by the dashed arrows 124.

When the differential pressure across the valve 110 changes from a positive differential pressure (+ΔP) back to a negative differential pressure (−ΔP) as indicated by the downward pointing arrow in FIG. 8B, fluid begins flowing in the opposite direction through the valve 110 as indicated by the dashed arrows 132, which forces the flap 117 back toward the closed position shown in FIG. 8C. In FIG. 8B, the fluid pressure between the flap 117 and the sealing plate 116 is lower than the fluid pressure between the flap 117 and the retention plate 114. Thus, the flap 117 experiences a net force, represented by arrows 138, which accelerates the flap 117 toward the sealing plate 116 to close the valve 110. In this manner, the changing differential pressure cycles the valve 110 between closed and open positions based on the direction (i.e., positive or negative) of the differential pressure across the valve 110. It should be understood that the flap 117 could be biased against the retention plate 114 in an open position when no differential pressure is applied across the valve 110, i.e., the valve 110 would then be in a "normally open" position.

When the differential pressure across the valve 110 reverses to become a positive differential pressure (+ΔP) as shown in FIGS. 5B and 8A, the biased flap 117 is motivated away from the sealing plate 116 against the retention plate 114 into the open position. In this position, the movement of the flap 117 unblocks the holes 120 of the sealing plate 116 so that fluid is permitted to flow through them and the aligned holes 118 of the retention plate 114 and the holes 122 of the flap 117 as indicated by the dashed arrows 124. When the differential pressure changes from the positive differential pressure (+ΔP) back to the negative differential pressure (−ΔP), fluid begins to flow in the opposite direction through the valve 110 (see FIG. 8B), which forces the flap 117 back toward the closed position (see FIG. 8C). Thus, as the pressure oscillations in the cavities 16, 17 cycle the valve 110 between the normally closed position and the open position, the pump 10 provides reduced pressure every half cycle when the valve 110 is in the open position.

As indicated above, the operation of the valve 110 is a function of the change in direction of the differential pressure (ΔP) of the fluid across the valve 110. The differential pressure (ΔP) is assumed to be substantially uniform across the entire surface of the retention plate 114 because (1) the diameter of the retention plate 114 is small relative to the wavelength of the pressure oscillations in the cavity 115, and (2) the valve 110 is located near the centre of the cavities 16, 17 where the amplitude of the positive central pressure anti-node 45 is relatively constant as indicated by the positive square-shaped portion 55 of the positive central pressure anti-node 45 and the negative square-shaped portion 65 of the negative central pressure anti-node 47 shown in FIG. 6. Therefore, there is virtually no spatial variation in the pressure across the center portion 111 of the valve 110.

Figures 9A, 9B:
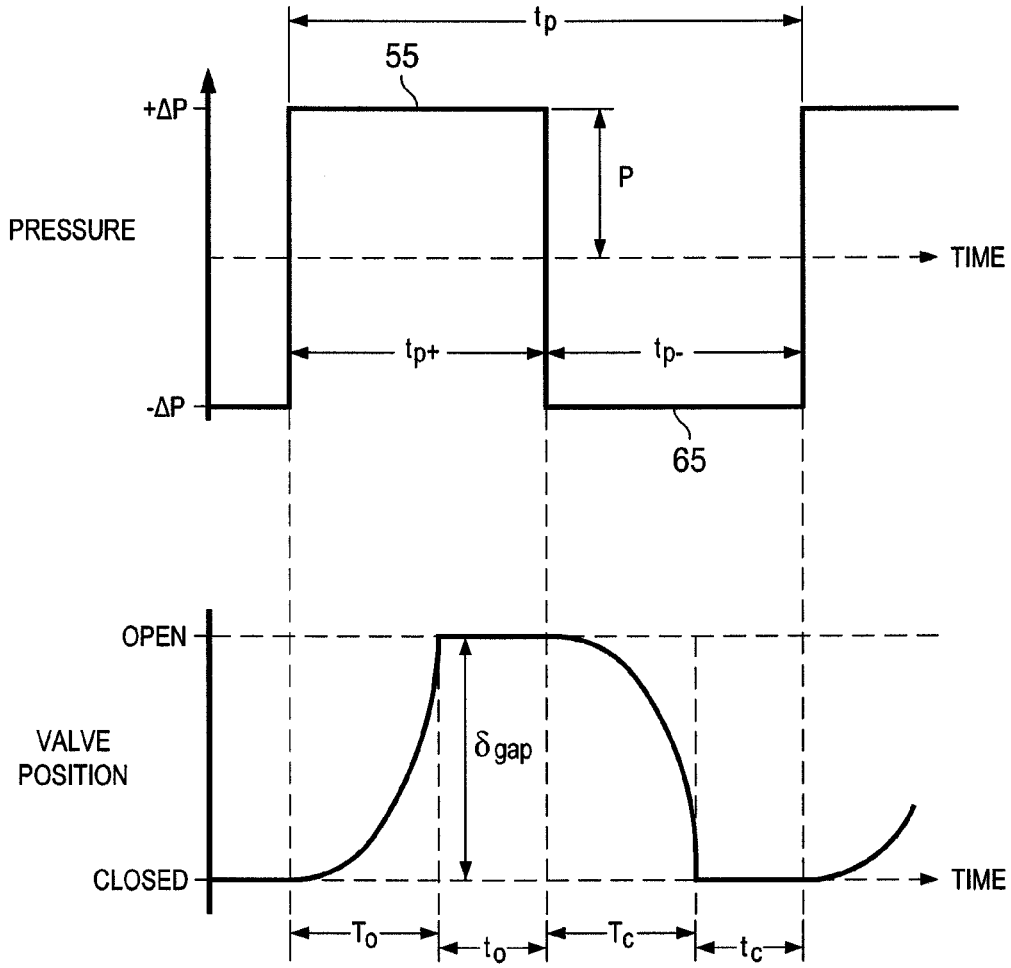
FIG. 9A shows a pressure graph of an oscillating differential pressure applied across the valve of FIG. 5B according to an illustrative embodiment.
FIG. 9B shows a fluid-flow graph of an operating cycle of the valve of FIG. 5B between an open and closed position.

FIG. 9 further illustrates the dynamic operation of the valve 110 when it is subject to a differential pressure which varies in time between a positive value (+ΔP) and a negative value (−ΔP). While in practice the time-dependence of the differential pressure across the valve 110 may be approximately sinusoidal, the time-dependence of the differential pressure across the valve 110 is approximated as varying in the square-wave form shown in FIG. 9A to facilitate explanation of the operation of the valve. The positive differential pressure 55 is applied across the valve 110 over the positive pressure time period ($t_{p+}$) and the negative differential pressure 65 is applied across the valve 110 over the negative pressure time period ($t_{p-}$) of the square wave. FIG. 9B illustrates the motion of the flap 117 in response to this time-varying pressure. As differential pressure (ΔP) switches from negative 65 to positive 55 the valve 110 begins to open and continues to open over an opening time delay ($T_o$) until the valve flap 117 meets the retention plate 114 as also described above and as shown by the graph in FIG. 9B. As differential pressure (ΔP) subsequently switches back from positive differential pressure 55 to negative differential pressure 65, the valve 110 begins to close and continues to close over a closing time delay ($T_c$) as also described above and as shown in FIG. 9B.

The retention plate 114 and the sealing plate 116 should be strong enough to withstand the fluid pressure oscillations to which they are subjected without significant mechanical deformation. The retention plate 114 and the sealing plate 116 may be formed from any suitable rigid material, such as glass, silicon, ceramic, or metal. The holes 118, 120 in the retention plate 114 and the sealing plate 116 may be formed by any suitable process including chemical etching, laser machining, mechanical drilling, powder blasting, and stamping. In one embodiment, the retention plate 114 and the sealing plate 116 are formed from sheet steel between 100 and 200 microns thick, and the holes 118, 120 therein are formed by chemical etching. The flap 117 may be formed from any lightweight material, such as a metal or polymer film. In one embodiment, when fluid pressure oscillations of 20 kHz or greater are present on either the retention plate side or the sealing plate side of the valve 110, the flap 117 may be formed from a thin polymer sheet between 1 micron and 20 microns in thickness. For example, the flap 117 may be formed from polyethylene terephthalate (PET) or a liquid crystal polymer film approximately 3 microns in thickness.

Figure 10A:
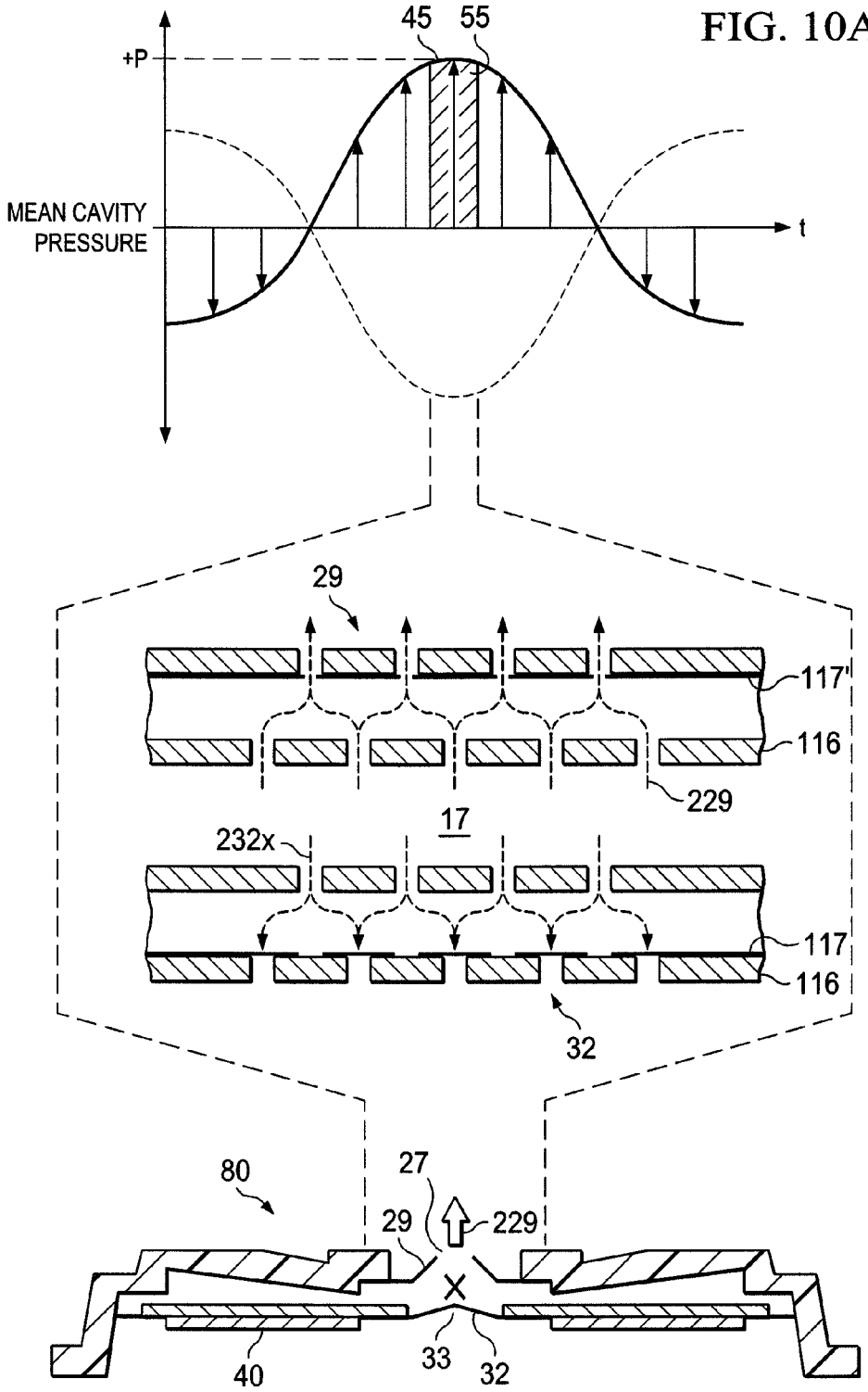
FIGS. 10A and 10B show a schematic, cross-section view of the fourth pump of FIG. 3 including an exploded view of the center portion of the valves and a graph of the positive and negative portion, of an oscillating pressure wave, respectively, being applied within a cavity.
Figure 10B:
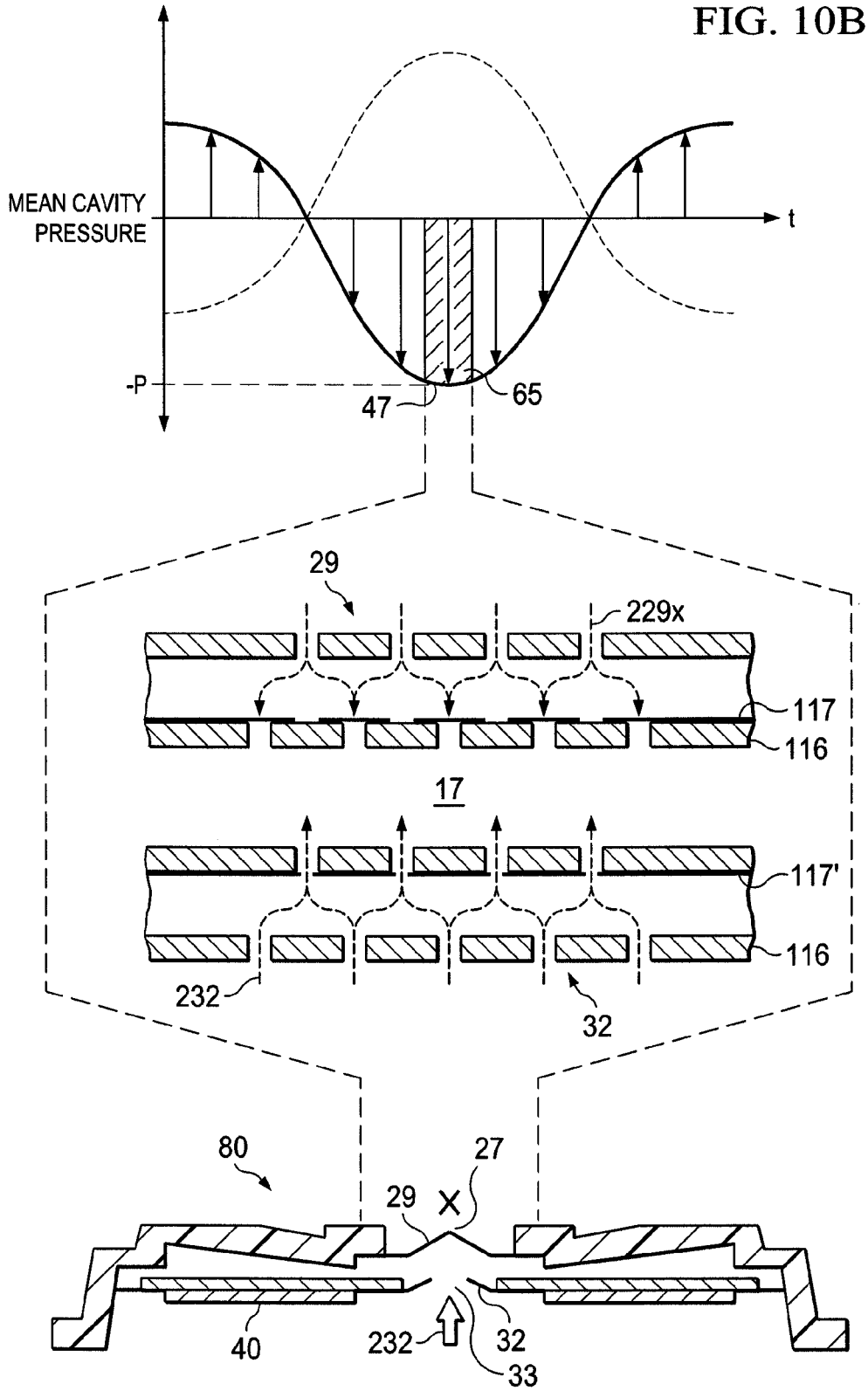
Figures 11, 11A, 11B:
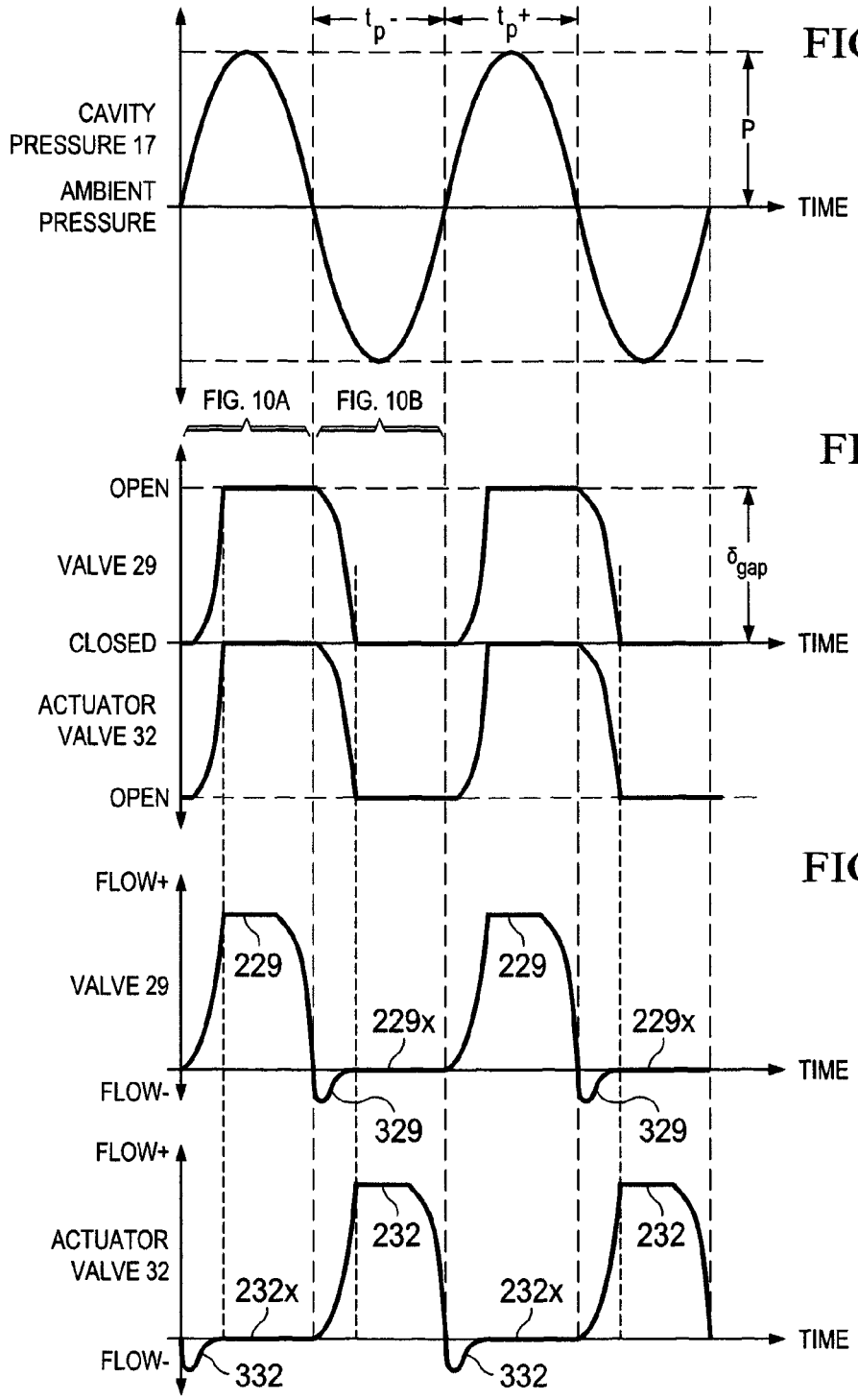
FIG. 11 shows the open and closed states of the valves of the fourth pump.
FIGS. 11A and 11B shows the resulting flow and pressure characteristics, respectively, when the fourth pump is in a free-flow mode.

Referring now to FIGS. 10A and 10B, an exploded view of the two-valve pump 80 is shown that utilizes valve 110 as valves 29 and 32. In this embodiment the actuator valve 32 gates airflow 232 between the inlet aperture 33 and cavity 17 of the pump 80 (FIG. 10A), while end valve 29 gates airflow between the cavity 17 and the outlet aperture 27 of the pump 80 (FIG. 10B). Each of the figures also shows the pressure generated in the cavity 17 as the actuator 40 oscillates. Both of the valves 29 and 32 are located near the center of the cavity 17 where the amplitudes of the positive and negative central pressure anti-nodes 45 and 47, respectively, are relatively constant as indicated by the positive and negative square-shaped portions 55 and 65, respectively, as described above. In this embodiment, the valves 29 and 32 are both biased in the closed position as shown by the flap 117 and operate as described above when the flap 117 is motivated to the open position as indicated by flap 117'. The figures also show an exploded view of the positive and negative square-shaped portions 55, 65 of the central pressure anti-nodes 45, 47 and their simultaneous impact on the operation of both valves 29, 32 and the corresponding airflow 229 and 232, respectively, generated through each one Referring also to the relevant portions of FIGS. 11, 11A and 11B, the open and closed states of the valves 29 and 32 (FIG. 11) and the resulting flow characteristics of each one (FIG. 11A) are shown as related to the pressure in the cavity 17 (FIG. 11B). When the inlet aperture 33 and the outlet aperture 27 of the pump 80 are both at ambient pressure and the actuator 40 begins vibrating to generate pressure oscillations within the cavity 17 as described above, air begins flowing alternately through the valves 29, 32 causing air to flow from the inlet aperture 33 to the outlet aperture 27 of the pump 80, i.e., the pump 80 begins operating in a "free-flow" mode. In one embodiment, the inlet aperture 33 of the pump 80 may be supplied with air at ambient pressure while the outlet aperture 27 of the pump 80 is pneumatically coupled to a load (not shown) that becomes pressurized through the action of the pump 80. In another embodiment, the inlet aperture 33 of the pump 80 may be pneumatically coupled to a load (not shown) that becomes depressurized to generate a negative pressure in the load, such as a wound dressing, through the action of the pump 80.

Referring more specifically to FIG. 10A and the relevant portions of FIGS. 11, 11A and 11B, the square-shaped portion 55 of the positive central pressure anti-node 45 is generated within the cavity 17 by the vibration of the actuator 40 during one half of the pump cycle as described above. When the inlet aperture 33 and outlet aperture 27 of the pump 80 are both at ambient pressure, the square-shaped portion 55 of the positive central anti-node 45 creates a positive differential pressure across the end valve 29 and a negative differential pressure across the actuator valve 32. As a result, the actuator valve 32 begins closing and the end valve 29 begins opening so that the actuator valve 32 blocks the airflow 232*x* through the inlet aperture 33, while the end valve 29 opens to release air from within the cavity 17 allowing the airflow 229 to exit the cavity 17 through the outlet aperture 27. As the actuator valve 32 closes and the end valve 29 opens (FIG. 11), the airflow 229 at the outlet aperture 27 of the pump 80 increases to a maximum value dependent on the design characteristics of the end valve 29 (FIG. 11A). The opened end valve 29 allows airflow 229 to exit the pump cavity 17 (FIG. 11 B) while the actuator valve 32 is closed. When the positive differential pressure across end valve 29 begins to decrease, the airflow 229 begins to drop until the differential pressure across the end valve 29 reaches zero. When the differential pressure across the end valve 29 falls below zero, the end valve 29 begins to close allowing some back-flow 329 of air through the end valve 29 until the end valve 29 is fully closed to block the airflow 229*x* as shown in FIG. 10B.

Referring more specifically to FIG. 10B and the relevant portions of FIGS. 11, 11A, and 11B, the square-shaped portion 65 of the negative central anti-node 47 is generated within the cavity 17 by the vibration of the actuator 40 during the second half of the pump cycle as described above. When the inlet aperture 33 and outlet aperture 27 of the pump 80 are both at ambient pressure, the square-shaped portion 65 the negative central anti-node 47 creates a negative differential pressure across the end valve 29 and a positive differential pressure across the actuator valve 32. As a result, the actuator valve 32 begins opening and the end valve 29 begins closing so that the end valve 29 blocks the airflow 229*x* through the outlet aperture 27, while the actuator valve 32 opens allowing air to flow into the cavity 17 as shown by the airflow 232 through the inlet aperture 33. As the actuator valve 32 opens and the end valve 29 closes (FIG. 11), the airflow at the outlet aperture 27 of the pump 80 is substantially zero except for the small amount of backflow 329 as described above (FIG. 11A). The opened actuator valve 32 allows airflow 232 into the pump cavity 17 (FIG. 11B) while the end valve 29 is closed. When the positive pressure differential across the actuator valve 32 begins to decrease, the airflow 232 begins to drop until the differential pressure across the actuator valve 32 reaches zero. When the differential pressure across the actuator valve 32 rises above zero, the actuator valve 32 begins to close again allowing some back-flow 332 of air through the actuator valve 32 until the actuator valve 32 is fully closed to block the airflow 232*x* as shown in FIG. 10A. The cycle then repeats itself as described above with respect to FIG. 10A. Thus, as the actuator 40 of the pump 80 vibrates during the two half cycles described above with respect to FIGS. 10A and 10B, the differential pressures across valves 29 and 32 cause air to flow from the inlet aperture 33 to the outlet aperture 27 of the pump 80 as shown by the airflows 232, 229, respectively.

Figure 12:
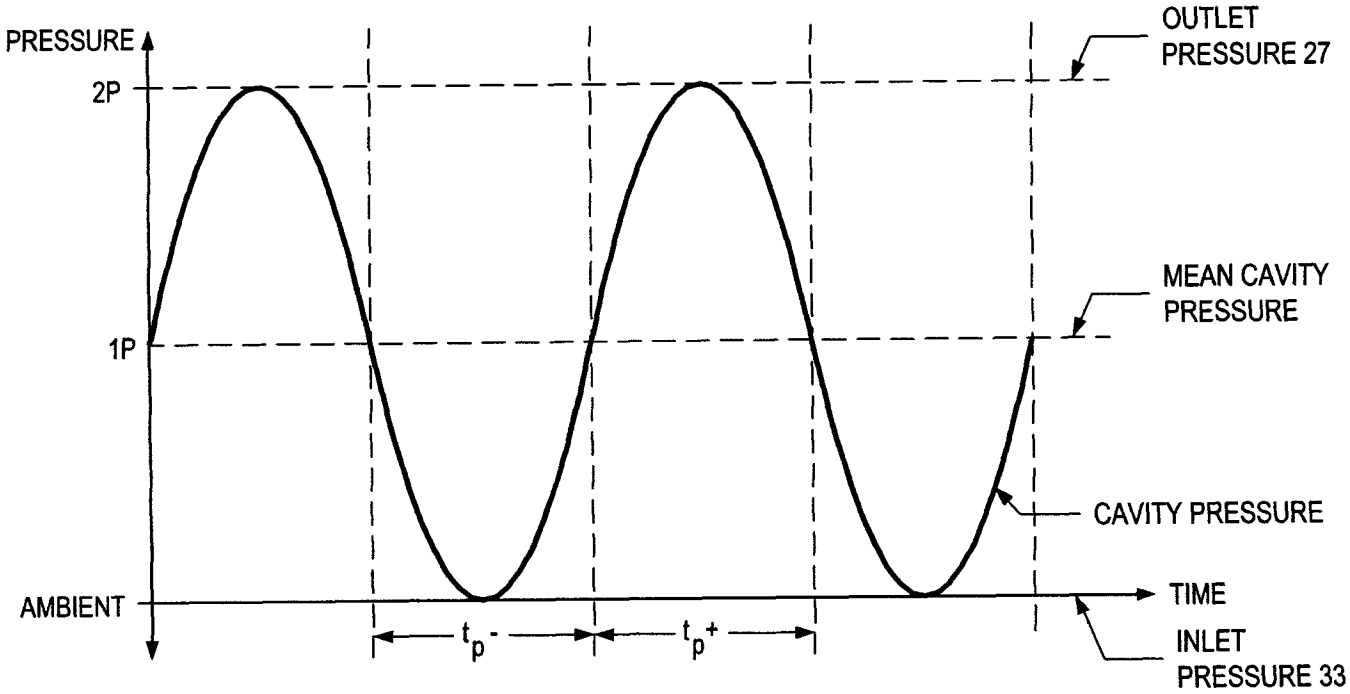
FIG. 12 shows a graph of the maximum differential pressure provided by the fourth pump when the pump reaches the stall condition.

In the case where the inlet aperture 33 of the pump 80 is held at ambient pressure and the outlet aperture 27 of the pump 80 is pneumatically coupled to a load that becomes pressurized through the action of the pump 80, the pressure at the outlet aperture 27 of the pump 80 begins to increase until the outlet aperture 27 of the pump 80 reaches a maximum pressure at which time the airflow from the inlet aperture 33 to the outlet aperture 27 is negligible, i.e., the "stall" condition. FIG. 12 illustrates the pressures within the cavity 17 and outside the cavity 17 at the inlet aperture 33 and the outlet aperture 27 when the pump 80 is in the stall condition. More specifically, the mean pressure in the cavity 17 is approximately 1P above the inlet pressure (i.e. 1P above ambient pressure) and the pressure at the centre of the cavity 17 varies between approximately ambient pressure and approximately ambient pressure plus 2P. In the stall condition, there is no point in time at which the pressure oscillation in the cavity 17 results in a sufficient positive differential pressure across either inlet valve 32 or outlet valve 29 to significantly open either valve to allow any airflow through the pump 80. Because the pump 80 utilizes two valves, the synergistic action of the two valves 29, 32 described above is capable of increasing the differential pressure between the outlet aperture 27 and the inlet aperture 33 to a maximum differential pressure of 2P, double that of a single valve pump. Thus, under the conditions described in the previous paragraph, the outlet pressure of the two-valve pump 80 increases from ambient in the free-flow mode to a pressure of approximately ambient plus 2P when the pump 80 reaches the stall condition.

Figure 13A:
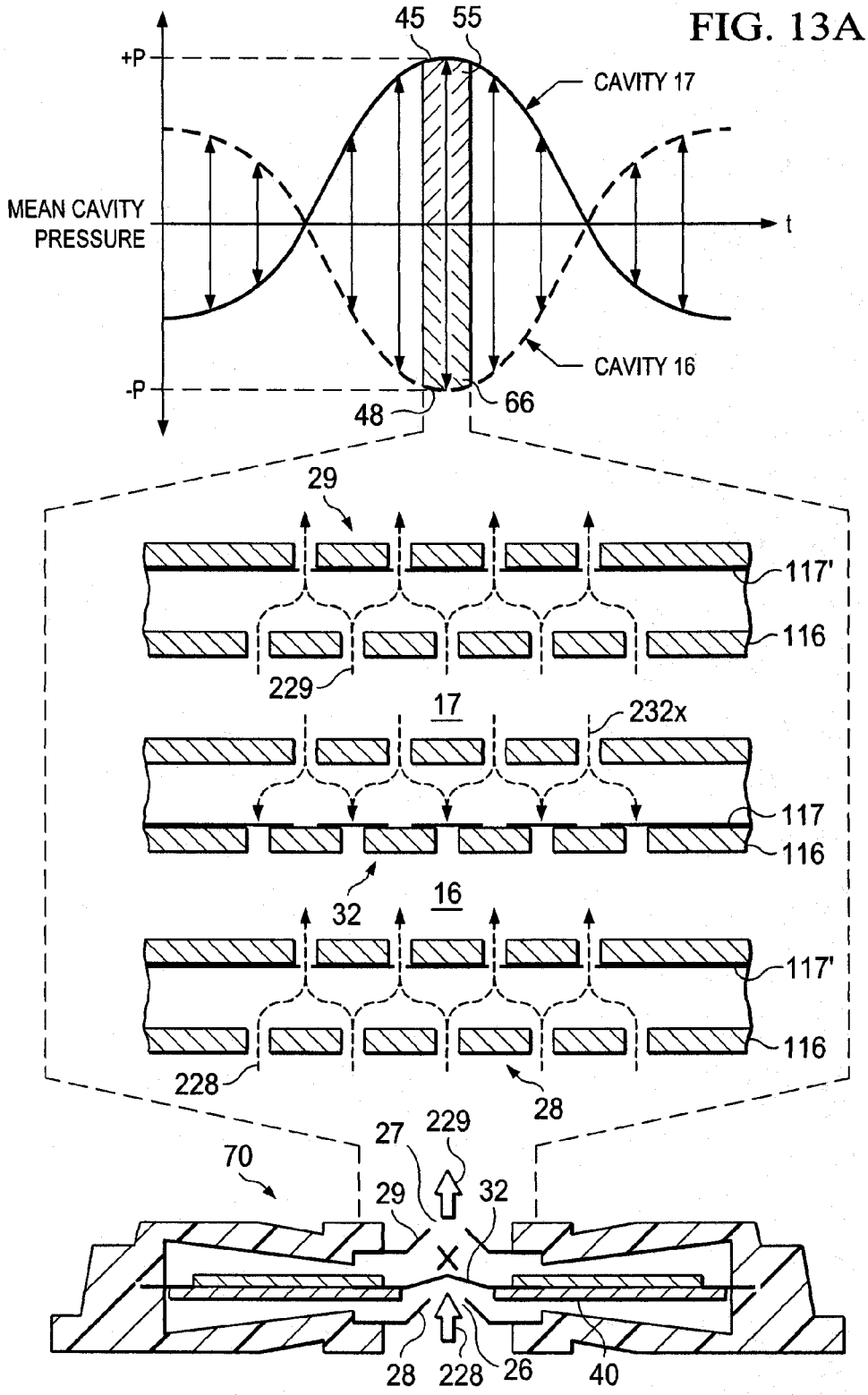
FIGS. 13A and 13B show a schematic, cross-section view of the third pump of FIG. 2B including an exploded view of the center portion of the valves and a graph of the positive and negative portion, of oscillating pressure waves, respectively, being applied within two cavities.
Figure 13B:
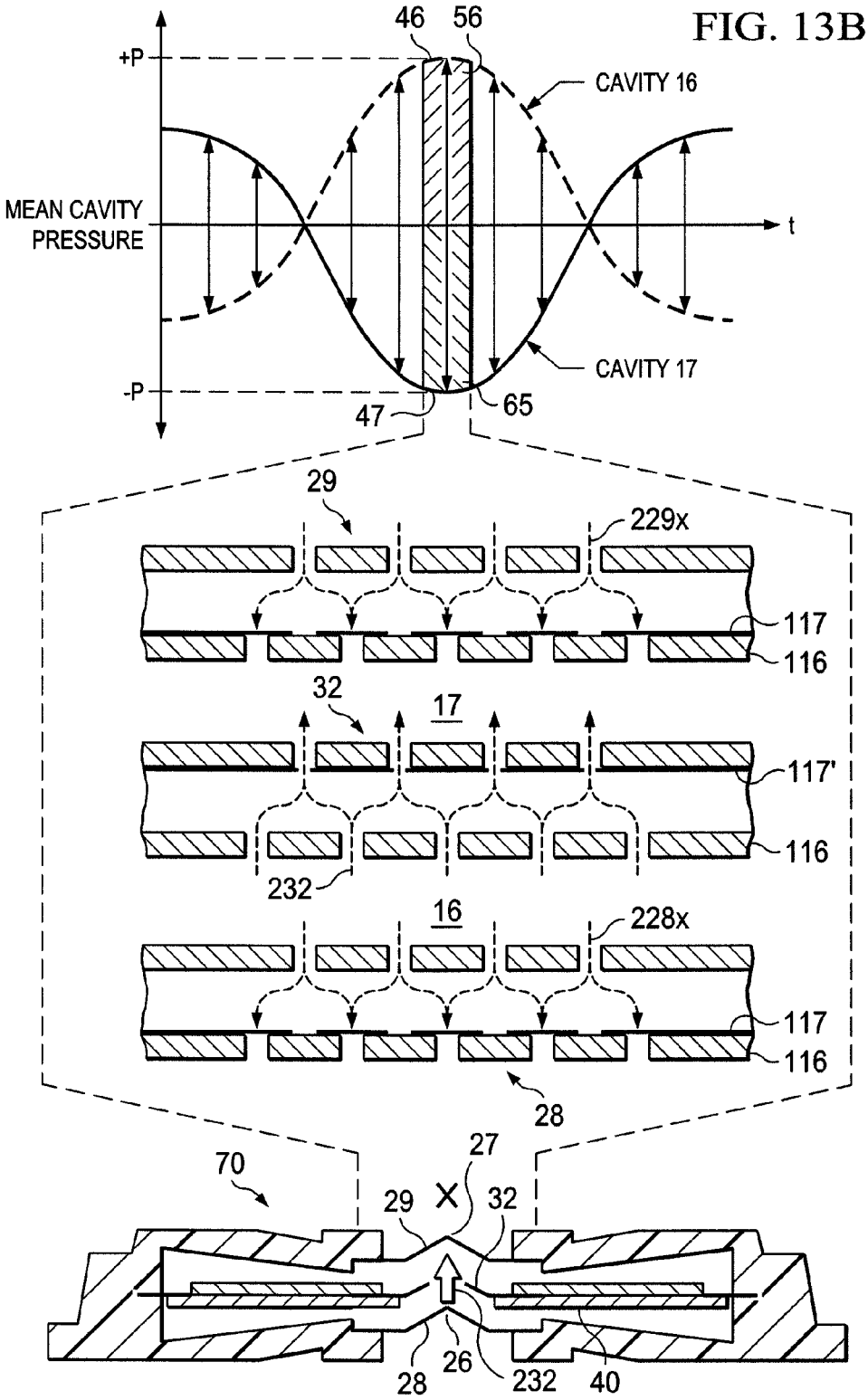

Referring now to FIGS. 13A and 13B, an exploded view of the 3-valve pump 70 that utilizes valve 110 as valves 28, 29 and 32 is shown. In this embodiment the end valve 28 gates airflow 228 between the inlet aperture 26 and the cavity 16 of the pump 70, while the end valve 29 gates airflow 229 between the cavity 17 and the outlet aperture 27 of the pump 70 (FIG. 13A). The actuator valve 32 is positioned between the cavities 16, 17 and gates the airflow 232 between these cavities (FIG. 13B). The valves 28, 29 and 32 are all biased in the closed position as shown by the flaps 117 and operate as described above when the flaps 117 are motivated to the open position as indicated by the flaps 117'. In operation the actuator 40 of the 3-valve pump 70 creates pressure oscillations in each of cavities 16 and 17 including a primary pressure oscillation within the cavity 17 on one side of the actuator 40 and a complementary pressure oscillation within the cavity 16 on the other side of the actuator 40. The primary and complementary pressure oscillations within cavities 17, 16 are approximately 180° out of phase with one another as indicated by the solid and dashed curves respectively in FIGS. 13A, 13B and 14B. All three of the valves 28, 29, and 32 are located near the center of the cavities 16 and 17 where (i) the amplitude of the primary positive and negative central pressure anti-nodes 45 and 47, respectively, in the cavity 17 is relatively constant as indicated by the positive and negative square-shaped portions 55 and 65, respectively, as described above, and (ii) the amplitude of the complementary positive and negative central pressure anti-nodes 46 and 48, respectively, in the cavity 16 is also relatively constant as indicated by the positive and negative square-shaped portions 56 and 66, respectively. These figures also show an exploded views of the pump 70 showing (i) the impact of the positive and negative square-shaped portions 55, 65 within the cavity 17 on the operation of the end valve 29 and the actuator valve 32 including the corresponding airflows 229 and 232, respectively, generated through both of them and exiting the outlet aperture 27, and (i) the impact of the positive and negative square-shaped portions 56, 66 within the cavity 16 on the operation of the end valve 28 and the actuator valve 32 including the corresponding airflows 228 and 232, respectively, generated through both of them from the inlet aperture 26.

Figures 14, 14A, 14B:
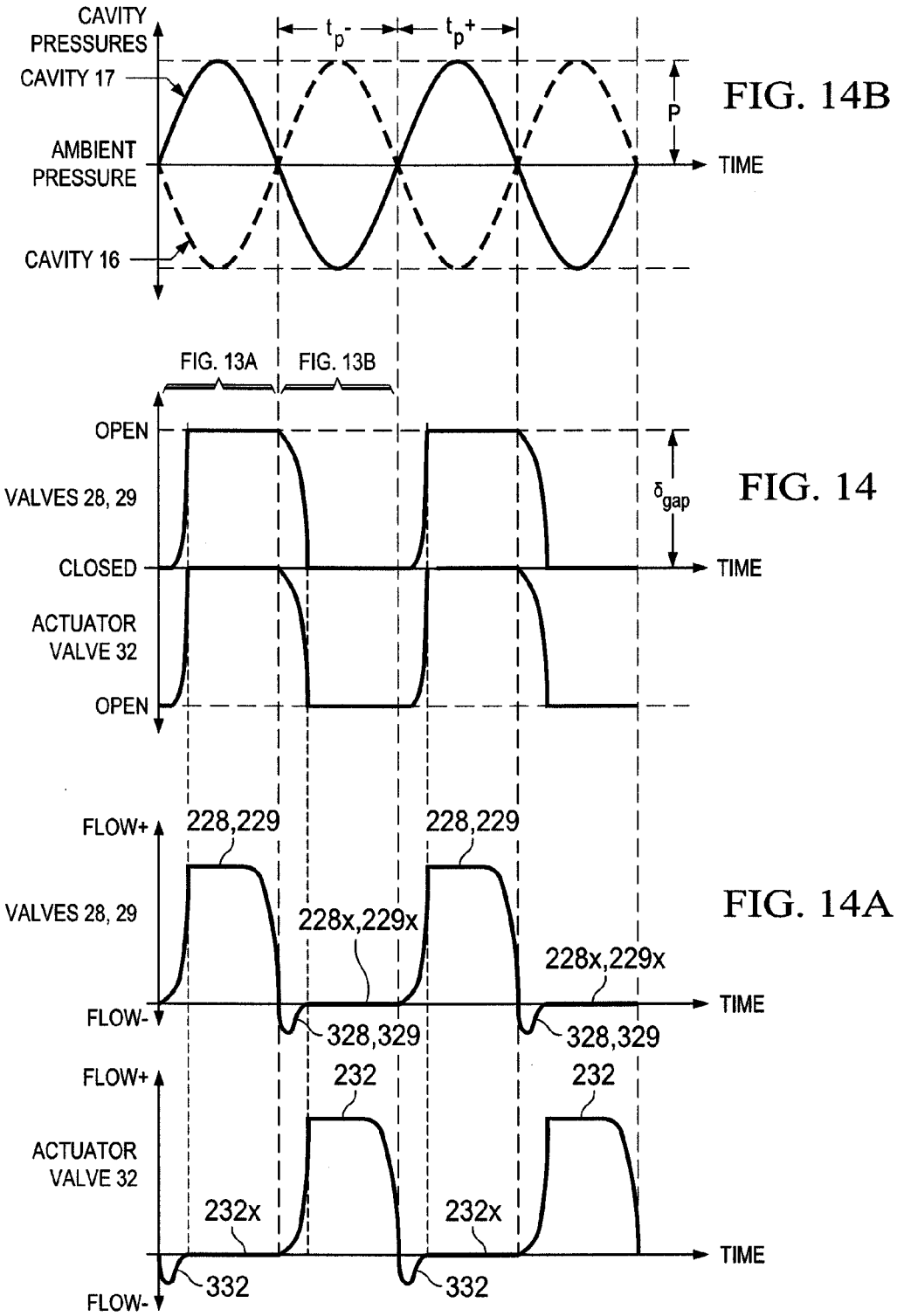
FIG. 14 shows the open and closed states of the valves of the third pump.
FIGS. 14A and 14B shows the resulting flow and pressure characteristics, respectively, when the third pump is in a free-flow mode.

Referring more specifically to the relevant portions of FIGS. 14, 14A and 14B, the open and closed states of the end valves 28, 29 and the actuator valve 32 (FIG. 14), and the resulting flow characteristics of each one (FIG. 14A) are shown as related to the pressure in the cavities 16, 17 (FIG. 14B). When the inlet aperture 26 and the outlet aperture 27 of the pump 70 are both at ambient pressure and the actuator 40 begins vibrating to generate pressure oscillations within the cavities 16, 17 as described above, air begins flowing alternately through the end valves 28, 29 and the actuator valve 32 causing air to flow from the inlet aperture 26 to the outlet aperture 27 of the pump 70, i.e., the pump 70 begins operating in a "free-flow" mode as described above. In one embodiment, the inlet aperture 26 of the pump 70 may be supplied with air at ambient pressure while the outlet aperture 27 of the pump 70 is pneumatically coupled to a load (not shown) that becomes pressurized through the action of the pump 70. In another embodiment, the inlet aperture 26 of the pump 70 may be pneumatically coupled to a load (not shown) that becomes depressurized to generate a negative pressure through the action of the pump 70.

Referring more specifically to FIG. 13A and the relevant portions of FIGS. 14, 14A and 14B, the positive square-shaped portion 55 of the primary positive center pressure anti-node 45 is generated within the cavity 17 by the vibration of the actuator 40 during one half of the pump cycle as described above, while at the same time the complementary negative square-shaped portion 66 of the complementary negative center pressure anti-node 48 is generated on the other side of the actuator 40 within the cavity 16. When the inlet aperture 26 and outlet aperture 27 are both at ambient pressure, the positive square-shaped portion 55 of the positive central anti-node 45 creates a positive differential pressure across the end valve 29 and the negative square-shaped portion 66 of the negative central anti-node 48 creates a positive differential pressure across the end valve 28. The combined action of the primary positive square-shaped portion 55 and the complementary negative square-shaped portion 66 create a negative differential pressure across the valve 32. As a result, the actuator valve 32 begins closing and the end valves 28, 29 simultaneously begin opening so that the actuator valve 32 blocks the airflow 232*x* while the end valves 28, 29 open to (i) release air from within the cavity 17 allowing the airflow 229 to exit the cavity 17 through the outlet aperture 27, and (ii) draw air into the cavity 16 allowing airflow 228 into the cavity 16 through the inlet aperture 26. As the actuator valve 32 closes and the end valves 28, 29 open (FIG. 14), the airflow 229 at the outlet aperture 27 of the pump 70 increases to a maximum value dependent on the design characteristics of the end valve 29 (FIG. 14A). The open end valve 29 allows airflow 229 to exit the pump cavity 17 (FIG. 11B) while the actuator valve 32 is closed. When the positive differential pressure across the end valves 28, 29 begin to decrease, the airflows 228, 229 begin to drop until the differential pressure across the end valves 28, 29 reaches zero. When the differential pressure across the end valves 28, 29 fall below zero, the end valves 28, 29 begin to close allowing some back-flow 328, 329 of air through the end valves 28, 29 until they are fully closed to block the airflow 228*x*, 229*x* as shown in FIG. 13B.

Referring more specifically to FIG. 13B and the relevant portions of FIGS. 14, 14A and 14B, the primary negative square-shaped portion 65 of the primary negative center pressure anti-node 47 is generated within the cavity 17 by the vibration of the actuator 40 during the second half of the pump cycle, while at the same time the complementary positive square-shaped portion 56 of the complementary positive central pressure anti-node 46 is generated within the cavity 16 by the vibration of the actuator 40. When the inlet aperture 26 and outlet aperture 27 are both at ambient pressure, the primary negative square-shaped portion 65 of the primary negative central anti-node 47 creates a negative differential pressure across the end valve 29 and the complementary positive square-shaped portion 56 of the complementary positive central anti-node 46 creates a negative differential pressure across the end valve 28. The combined action of the primary negative square-shaped portion 65 and the complementary positive square-shaped portion 56 creates a negative differential pressure across the valve 32. As a result, the actuator valve 32 begins opening and the end valves 28, 29 begin closing so that the end valves 28, 29 block the airflows 228*x*, 229*x*, respectively, through the inlet aperture 26 and the outlet aperture 27, while the actuator valve 32 opens to allow airflow 232 from the cavity 16 into the cavity 17. As the actuator valve 32 opens and the end valves 28, 29 close (FIG. 14), the airflows at the inlet aperture 26 and the outlet aperture 27 of the pump 70 are substantially zero except for the small amount of backflow 328, 329 through each valve (FIG. 14A). When the positive differential pressure across the actuator valve 32 begins to decrease, the airflow 232 begins to drop until the differential pressure across the actuator valve 32 reaches zero. When the differential pressure across the actuator valve 32 rises above zero, the actuator valve 32 begins to close again allowing some back-flow 332 of air through the actuator valve 32 until the actuator valve 32 is fully closed to block the airflow 232*x* as shown in FIG. 13A. The cycle then repeats itself as described above with respect to FIG. 13A. Thus, as the actuator 40 of the pump 70 vibrates during the two have cycles described above with respect to FIGS. 13A and 13B, the differential pressures across the valves 28, 29 and 32 cause air to flow from the inlet aperture 26 to the outlet aperture 27 of the pump 70 as shown by the airflows 228, 232, and 229.

Figure 15:
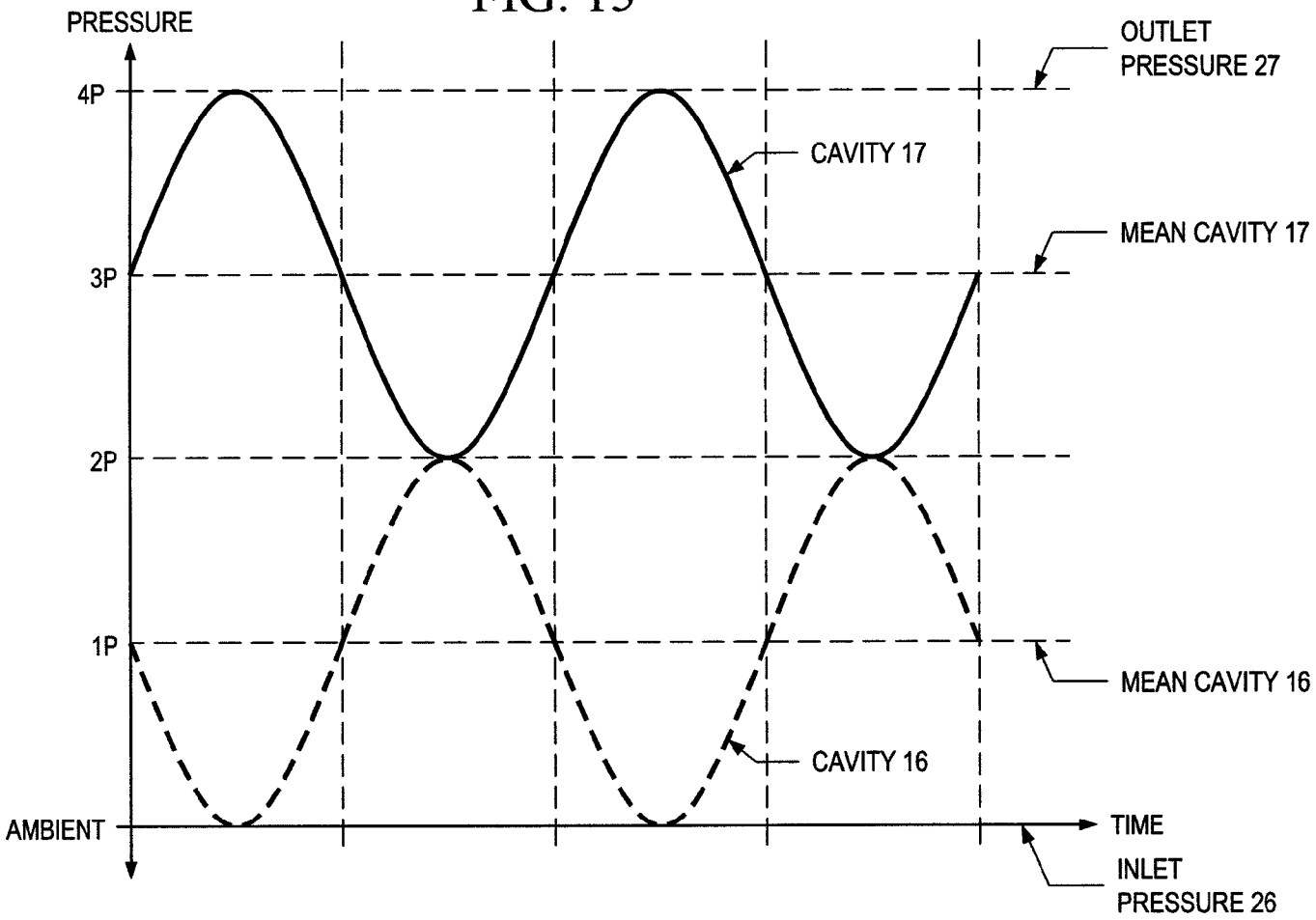
FIG. 15 shows a graph of the maximum differential pressure provided by the third pump when the pump reaches the stall condition.

In the case where the inlet aperture 26 of the pump 70 is held at ambient pressure and the outlet aperture 27 of the pump 70 is pneumatically coupled to a load that becomes pressurized through the action of the pump 70, the pressure at the outlet aperture 27 of the pump 70 begins to increase until the pump 70 reaches a maximum pressure at which time the airflow at the outlet aperture 27 is negligible, i.e., the stall condition. FIG. 15 illustrates the pressures within the cavities 16, 17, outside the cavity 16 at the inlet aperture 26, and outside the cavity 17 at the outlet aperture 27 when the pump 70 is in the stall condition. More specifically, the mean pressure in the cavity 16 is approximately 1P above the inlet pressure (i.e. 1P above ambient pressure) and the pressure at the centre of the cavity 16 varies between approximately ambient pressure and approximately ambient pressure plus 2P. At the same time the mean pressure in the cavity 17 is approximately 3P above the inlet pressure and the pressure at the centre of the cavity 17 varies between approximately ambient pressure plus 2P and approximately ambient pressure plus 4P. In this stall condition, there is no point in time at which the pressure oscillations in the cavities 16, 17 result in a sufficient positive differential pressure across any of valves 28, 29, or 32 to significantly open any valve to allow any airflow through the pump 70.

Because the pump 70 utilizes three valves with two cavities, the pump 70 is capable of increasing the differential pressure between the inlet aperture 26 and the outlet aperture 27 of the pump 70 to a maximum differential pressure of 4P, four times that of a single valve pump. Thus, under the conditions described in the previous paragraph, the outlet pressure of the two-cavity, three-valve pump 70 increases from ambient in the free-flow mode to a maximum differential pressure of 4P when the pump reaches the stall condition.

Figures 16, 16A, 16B:
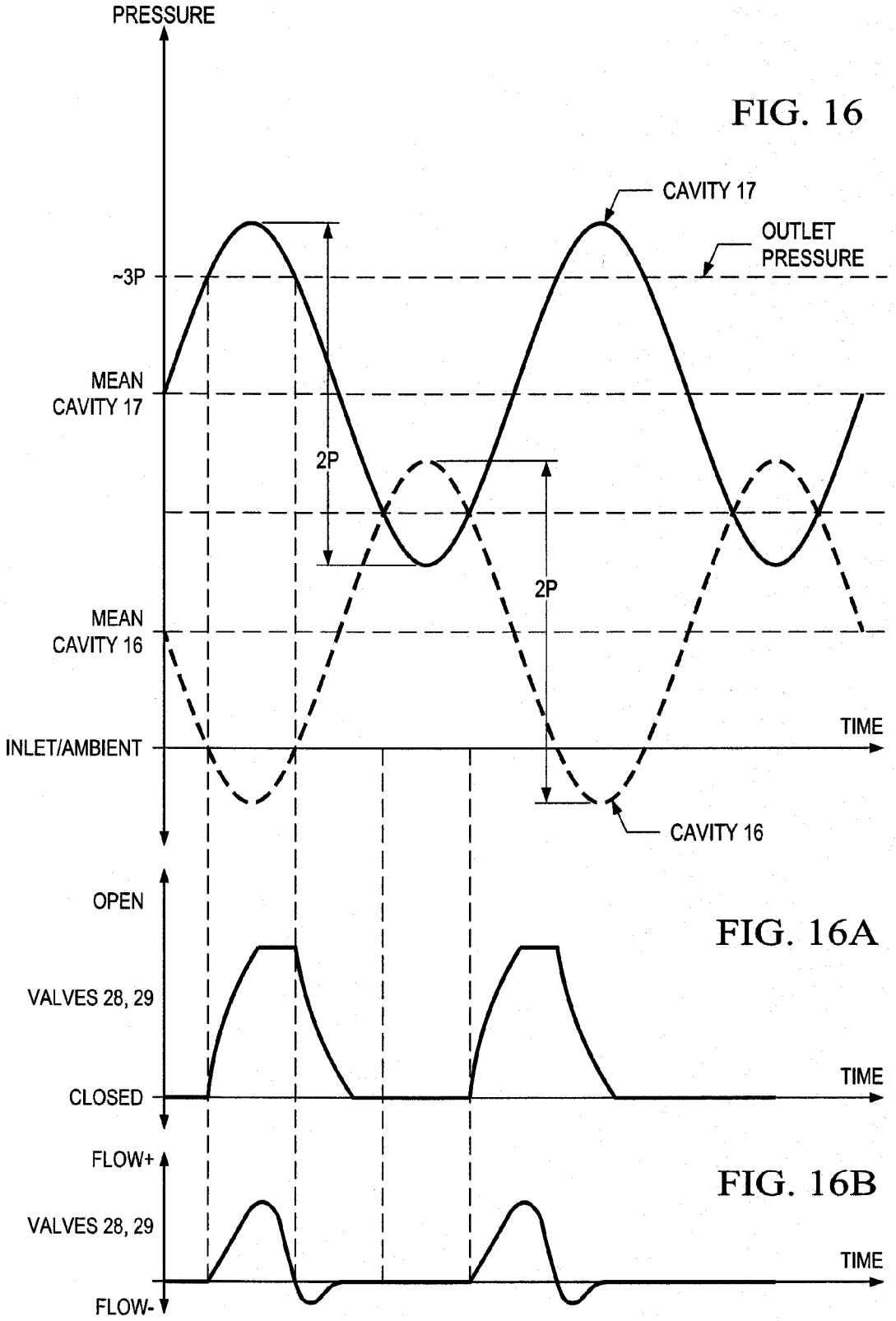
FIG. 16, 16A, and 16B show the open and closed states of the valves of the third pump, and the resulting flow and pressure characteristics when the third pump is operating near the stall condition.

It should be understood that the valve differential pressures, valve movements, and airflow operational characteristics vary significantly between the initial free-flow condition and the stall condition described above where there is virtually no airflow (FIGS. 12, 15). Referring for example to FIGS. 16, 16A, and 16B, the pump 70 is shown in a "near-stall" condition wherein the pump 70 is delivering a differential pressure of about 3P as shown in FIG. 16. As can be seen, the open/close duty cycle of the end valves 28, 29 is substantially lower than the duty cycle when the valves are in the free-flow mode (FIG. 16A), which substantially reduces the airflow from the outlet of the pump 70 as the total differential pressure increases (FIG. 16B).

It should be apparent from the foregoing that an invention having significant advantages has been provided. While the invention is shown in only a few of its forms, it is not just limited but is susceptible to various changes and modifications without departing from the spirit thereof.

We claim:

1. A pump comprising:

a pump body having a substantially elliptically shaped side wall having an internal radius (r) and closed by two end walls for containing fluids;

an actuator formed by an internal plate having a radius greater than or equal to 0.63(r) and a piezoelectric plate operatively associated with a central portion of the internal plate and adapted to cause an oscillatory motion at a frequency (f) thereby generating radial pressure oscillations of the fluid within the pump body;

an isolator having an inside perimeter coupled to a perimeter portion of the internal plate and an outside perimeter flexibly coupled to the side wall such that the actuator and the isolator form two cavities having a height (h) within the pump body, wherein the ratio of the internal radius (r) to the height (h) is greater than about 1.2;

a first aperture positioned near a center of and extending through said actuator to enable the fluid to flow from one cavity to the other cavity;

a first valve disposed in said first aperture to control the flow of fluid through said first aperture;

a second aperture positioned near a center of and extending through a first one of the end walls to enable the fluid to flow through the cavity adjacent the first one of the end walls;

a second valve disposed in said second aperture to control the flow of fluid through said second aperture;

a third aperture positioned near a center of and extending through a second one of the end walls to enable the fluid to flow through the cavity adjacent the second one of the end walls; and a third valve disposed in said third aperture to control the flow of fluid through said third aperture when in use.

2. The pump of claim 1, wherein the valves are flap valves.

3. The pump of claim 1, wherein the height (h) of each cavity and the radius (r) of each cavity are further related by the following equation: $h^2/r > 4\times10^{-10}$ meters.

4. The pump of claim 1, wherein the valves permit the fluid to flow through the cavity in substantially one direction.

5. The pump of claim 1, wherein the ratio r/h for each cavity is within the range between about 10 and about 50 when the fluid in use within the cavities is a gas.

6. The pump of claim 1, wherein a ratio of $h^2/r$ for each cavity is between about $10^{-3}$ meters and about $10^{-6}$ meters when the fluid in use within the cavities is a gas.

7. The pump of claim 1, wherein the volume of each cavity is less than about 10 ml.

8. The pump of claim 1, wherein one of the end walls has a frusto-conical shape wherein the height (h) of the cavity varies from a first height at the side wall to a smaller second height at about the centre of the end wall.

9. The pump of claim 1 wherein the oscillatory motion generates radial pressure oscillations of the fluid within the cavities causing fluid flow through said first aperture, second aperture, and third aperture.

10. The pump of claim 9 wherein a lowest resonant frequency of the radial pressure oscillations is greater than about 500 Hz.

11. The pump of claim 9 wherein a frequency of the oscillatory motion is about equal to the lowest resonant frequency of the radial pressure oscillations.

12. The pump of claim 9 wherein a frequency of the oscillatory motion is within 20% of the lowest resonant frequency of the radial pressure oscillations.

13. The pump of claim 9 wherein the oscillatory motion in each cavity is mode-shape matched to the radial pressure oscillations.

14. The pump of claim 1, wherein said isolator is a flexible membrane.

15. The pump of claim 14 wherein the flexible membrane is formed from plastic.

16. The pump of claim 15 wherein an annular width of the flexible membrane is between about 0.5 and 1.0 mm and a thickness of the flexible membrane is less than about 200 microns.

17. The pump of claim 14 wherein the flexible membrane is formed from metal.

18. The pump of claim 17 wherein an annular width of the flexible membrane is between about 0.5 and 1.0 mm and a thickness of the flexible membrane is less than about 20 microns.

19. The pump of claim 1 wherein each valve comprises at least two metal plates, a metal spacer and at least one polymer layer.

20. The pump of claim 19 wherein each valve has dimensions of about 250 microns in total thickness and about 7 mm in diameter when assembled.

* * * * *